US007845776B2

(12) United States Patent
Kachi

(10) Patent No.: US 7,845,776 B2
(45) Date of Patent: Dec. 7, 2010

(54) INKJET RECORDING APPARATUS

(75) Inventor: Yasuhiko Kachi, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 921 days.

(21) Appl. No.: 11/729,771

(22) Filed: Mar. 30, 2007

(65) Prior Publication Data

US 2007/0229613 A1 Oct. 4, 2007

(30) Foreign Application Priority Data

Mar. 31, 2006 (JP) ..... 2006-100454

(51) Int. Cl.
*B41J 2/175* (2006.01)

(52) U.S. Cl. ..... 347/85; 347/84; 347/86; 347/87; 347/91

(58) Field of Classification Search ..... 347/1–109
See application file for complete search history.

(56) References Cited

U.S. PATENT DOCUMENTS

| | | | | |
|---|---|---|---|---|
| 6,350,022 | B1 * | 2/2002 | Takemura et al. | 347/85 |
| 6,582,067 | B2 * | 6/2003 | Matsuzaki et al. | 347/85 |
| 6,652,089 | B2 * | 11/2003 | Silverbrook | 347/103 |
| 6,739,694 | B2 * | 5/2004 | Okamura et al. | 347/30 |
| 6,793,308 | B2 * | 9/2004 | Sugimoto et al. | 347/15 |
| 6,814,432 | B2 * | 11/2004 | Yamada et al. | 347/85 |
| 7,121,652 | B2 * | 10/2006 | Harada et al. | 347/85 |
| 7,237,884 | B2 * | 7/2007 | Sacco et al. | 347/86 |
| 7,367,652 | B2 * | 5/2008 | Miyazawa et al. | 347/49 |
| 7,377,635 | B2 * | 5/2008 | King et al. | 347/108 |
| 7,399,975 | B2 * | 7/2008 | Harrison | 250/372 |
| 7,488,060 | B2 * | 2/2009 | Umeda | 347/85 |
| 7,500,618 | B2 * | 3/2009 | Fujishiro et al. | 239/91 |
| 7,537,322 | B2 * | 5/2009 | Ishikawa et al. | 347/85 |
| 7,661,805 | B2 * | 2/2010 | Usui | 347/92 |
| 2005/0270344 | A1 | 12/2005 | Tsujimoto et al. | |

FOREIGN PATENT DOCUMENTS

| | | | |
|---|---|---|---|
| JP | 2003-200597 | A | 7/2003 |
| JP | 2003-200598 | A | 7/2003 |
| JP | 2004-338383 | A | 12/2004 |
| WO | WO-2004/096558 | A1 | 11/2004 |

* cited by examiner

*Primary Examiner*—Charlie Peng
*Assistant Examiner*—Guy G Anderson
(74) *Attorney, Agent, or Firm*—Birch, Stewart, Kolasch & Birch, LLP

(57) ABSTRACT

The inkjet recording apparatus includes: a casing; an inkjet head which is arranged in the casing and ejects ink from nozzles toward a recording medium; a scanning device which is arranged in the casing and moves the inkjet head to scan the recording medium in a scanning direction parallel with a breadthways direction of the recording medium; a recording medium supply device which accommodates the recording medium and is removably installed into the casing via a front face side of the casing and disposed on a lower side of the inkjet head in a vertical direction of the casing; a conveyance device which conveys the recording medium from the recording medium supply device to a recording region where the recording medium receives deposition of the ink ejected from the inkjet head, and conveys the recording medium within the recording region in a direction substantially perpendicular to the scanning direction; an ink cartridge which accommodates the ink to be supplied to the inkjet head and is removably installed into the casing via the front face side of the casing and disposed between the inkjet head and the recording medium supply device in the vertical direction of the casing; and an ink supply channel which is provided between the ink cartridge and the inkjet head.

11 Claims, 16 Drawing Sheets

INKJET RECORDING APPARATUS

BACKGROUND OF THE INVENTION

1. Field of the Invention

The present invention relates to an inkjet recording apparatus, and more particularly, to the structure of an inkjet recording apparatus which achieves a reduction in size of the whole apparatus.

2. Description of the Related Art

In recent years, inkjet recording apparatuses (inkjet printers) have become widely used as recording apparatuses which print and record images that have been captured by a digital still camera, and the like. The inkjet recording apparatus has a plurality of nozzles in a head, and records a prescribed image on the recording medium by ejecting ink droplets onto the recording medium from the nozzles. In many cases, inkjet recording apparatuses are situated on the same desk as other equipment, such as a personal computer, a scanner, a digital camera, and the like, and there are cases where these items of equipment are disposed in a stacked fashion in order that a plurality of items can be arranged compactly on one desk. Therefore, it has been sought in the inkjet recording apparatus to reduce the installation space by reducing the overall size of apparatuses and making them thinner in shape, as well as seeking to improve operability and maintenance characteristics by using a common surface of the apparatus for operations such as switching the power on and off, and maintenance tasks, such as supplying paper or replacing the ink.

Japanese Patent Application Publication No. 2004-338383 discloses that the overall size of an inkjet recording apparatus is made more compact by simplifying the structure of an ink supply system inside the apparatus, by adopting a method for supplying ink by connecting an ink cartridge to the recording head only when necessary. However, since a paper supply cassette is mounted on the rear side of the apparatus, then it is difficult to reduce the size of the apparatus in the depth direction, and a space for detaching and attaching the paper supply cassette must be left on the rear side of the apparatus. Therefore, it is not possible to reduce the installation surface area of the apparatus. Furthermore, this apparatus also has a structure in which the ink cartridges are inserted and removed via a side face, and therefore it is also necessary to leave space for inserting and removing ink cartridges, on the side face also.

Japanese Patent Application Publication Nos. 2003-200597 and 2003-200598 disclose an inkjet recording apparatus having a structure in which the operations of replacing an ink supply body, supplying paper, and outputting paper, can be carried out from the front face side of the apparatus. However, it is necessary to leave space for installing the ink cartridge in the carriage, and hence the carriage increases in size. In a mode which uses a vertical type ink cartridge as shown in FIG. 16 of Japanese Patent Application Publication No. 2003-200597 and FIG. 27 of Japanese Patent Application Publication No. 2003-200598, it is difficult make the apparatus compact in the height direction.

If the ink cartridge is not mounted on the carriage, then it is necessary to have tubing for connecting the ink cartridge with the recording head (carriage), and it is necessary to provide space for accommodating this tubing inside the apparatus. Since this tubing has a length which corresponds to the dimension of the recording head in the scanning direction (breadthways direction), then it is difficult to reduce the dimension of the apparatus in the breadthways direction.

SUMMARY OF THE INVENTION

The present invention has been contrived in view of the foregoing circumstances, an object thereof being to provide an inkjet recording apparatus whereby the overall apparatus can be made compact, as well as reducing the installation space including peripherally disposed equipment, and improving operability and maintenance characteristics.

In order to attain the aforementioned object, the present invention is directed to an inkjet recording apparatus, comprising: a casing; an inkjet head which is arranged in the casing and ejects ink from nozzles toward a recording medium; a scanning device which is arranged in the casing and moves the inkjet head to scan the recording medium in a scanning direction parallel with a breadthways direction of the recording medium; a recording medium supply device which accommodates the recording medium and is removably installed into the casing via a front face side of the casing and disposed on a lower side of the inkjet head in a vertical direction of the casing; a conveyance device which conveys the recording medium from the recording medium supply device to a recording region where the recording medium receives deposition of the ink ejected from the inkjet head, and conveys the recording medium within the recording region in a direction substantially perpendicular to the scanning direction; an ink cartridge which accommodates the ink to be supplied to the inkjet head and is removably installed into the casing via the front face side of the casing and disposed between the inkjet head and the recording medium supply device in the vertical direction of the casing; and an ink supply channel which is provided between the ink cartridge and the inkjet head.

According to this aspect of the present invention, since the recording medium supply device is disposed to the lower side of the inkjet head, in the vertical direction, the ink cartridge which accommodates ink to be supplied to the inkjet head is disposed between the inkjet head and the recording medium supply device in the vertical direction (in other words, in the conveyance space of the recording medium), and a composition is adopted whereby the recording medium supply device and the ink cartridge can be installed in and removed from the casing via the front face side of the casing, then it is possible to make the casing more compact, while also making the upper face of the casing a free space and thus allowing other items of equipment to be disposed on the upper face of the casing. Particularly beneficial effects are obtained in making the inkjet recording apparatus more compact in the installation direction of the recording medium supply device, namely, the depth direction.

By providing the ink cartridge to the lower side of the inkjet head in the vertical direction, a negative pressure is generated inside the inkjet head as a result of the displacement height (liquid head pressure differential) between the inkjet head (ink ejection surface of the inkjet head) and the ink cartridge.

Furthermore, the distance (height) of the ink cartridge in the vertical direction is set in such a manner that the internal pressure of the inkjet head at the ink ejection surface becomes −100 Pa to −500 Pa with respect to the atmospheric pressure.

In a mode which uses inks of a plurality of colors, then ink cartridges are provided for the respective colors, and the ink cartridges of the respective colors are disposed in such a manner that the distance in the vertical direction between each ink cartridge and the inkjet head is substantially the same. The front face of the casing is the surface which faces the user when the inkjet recording apparatus is installed for use, and it excludes the upper face and the bottom face of the casing. The front face of the casing may be a substantially planar surface or a substantially spherical surface, and it may also be constituted by two surfaces which form an angle (edge line).

Moreover, "recording medium" indicates a medium which receives ink ejected by means of the inkjet head, and this term includes various types of media, irrespective of material and size, such as continuous paper, cut paper, sealed paper, resin sheets, such as OHP sheets, film, cloth, and other materials.

The conveyance device which conveys the recording medium may adopt a mode which includes: a vertical conveyance section where a recording medium extracted from a recording medium supply device is conveyed toward the upper side in the vertical direction (a direction including the upper side in the vertical direction), in substantially the same plane as a perpendicular direction with respect to recording region of the inkjet head, and a horizontal conveyance section where the recording medium is conveyed horizontally to the recording region of the inkjet head.

Preferably, the inkjet recording apparatus further comprises: a coupling unit which is provided in at least one end portion of a scanning region of the inkjet head, and couples and separates the inkjet head with and from the ink supply channel, wherein the inkjet head and the ink supply channel are coupled together through the coupling unit when the ink is supplied to the inkjet head, and the inkjet head and the ink supply channel are separated from each other when the inkjet head is carrying out printing.

According to this aspect of the present invention, by adopting a composition in which the inkjet head and the ink supply channel can be coupled together and separated, there is no requirement to install an ink supply channel through the interior of the apparatus, and hence the ink supply channel can be arranged in a compact fashion.

A desirable mode is one where an opening and closing device, such as a check valve structure, is provided in order to achieve a composition in which both the inkjet head side and the ink supply channel side of the coupling section are closed when the inkjet head and the ink supply channel are in a separated state.

Preferably, the inkjet recording apparatus further comprises: a sub cartridge which includes the coupling unit, the ink supply channel, and an ink cartridge accommodating section which accommodates the ink cartridge, wherein: the sub cartridge is removably installed into the casing via the front face side of the casing and disposed to a lower side of the scanning region of the inkjet head in the vertical direction of the casing; and the ink cartridge accommodating section has an introduction aperture for introducing the ink cartridge in a face of the sub cartridge which faces the front face of the casing when the sub cartridge is installed in the casing.

According to this aspect of the present invention, by enclosing the coupling section between the inkjet head and the ink supply system, and the structure of the ink supply system itself, within the sub cartridge, it is possible to reduce the space occupied by the ink supply system inside the casing, and furthermore, it is possible to handle both the sub cartridge and the ink cartridge via the front face side of the casing, thus improving operability.

Preferably, the inkjet recording apparatus further comprises: a restoration processing device which carries out restoration process of the inkjet head, wherein the sub cartridge includes a waste ink accommodating section which accommodates waste ink generated during the restoration process of the inkjet head performed by the restoration processing device and is removably installed into the sub cartridge.

According to this aspect of the present invention, waste ink produced during the restoration processing of the inkjet head can be removed easily. For example, it is possible to replace only the waste ink accommodating section, when it has become filled with the waste ink.

There is a mode of the restoration processing device which includes a cap that acts as an ink receptacle during preliminary ejection, as well as preventing drying of the ink inside the inkjet head by being placed in tight contact with the ink ejection surface of the inkjet head. Moreover, there is also a mode in which the ink inside the inkjet head is suctioned by connecting a suctioning device, such as a pump, to the cap.

Preferably, the sub cartridge includes an ink receiving section which receives the ink ejected beyond edges of the recording medium during full-surface printing for a region corresponding to the scanning region of the inkjet head and is removably installed into the sub cartridge.

According to this aspect of the present invention, it is possible to replace only the ink accommodating section, when it has become soiled. Furthermore, when cleaning the ink accommodating section, improved operability can be expected by removing the ink accommodating section from the sub cartridge.

Preferably, the ink receiving section serves as a conveyance guide for the recording paper in the print region.

According to this aspect of the present invention, it is possible to simplify the structure of the recording region of the inkjet head.

Preferably, the inkjet recording apparatus further comprises a negative pressure maintaining unit which includes: an ink supply port which has a first opening and closing member, couples with the coupling unit, and is connected to an ink flow channel inside the inkjet head; and a sub tank of which portion of wall has an elastically deformable member, and is provided between the inkjet head and the ink supply port, wherein the negative pressure maintaining unit couples with the ink supply channel and maintains an internal pressure of the inkjet head at a liquid head pressure differential between the inkjet head and the ink cartridge during supply of the ink to the inkjet head, and seals an interior of the inkjet head by closing the first opening and closing member when the inkjet head is carrying out printing.

According to this aspect of the present invention, it is possible to maintain the internal pressure of the inkjet head by means of a simple structure, and consequently, there is no need to maintain a negative pressure by means of a pump, or the like, when the inkjet head is separated from the ink supply system. Therefore, the composition of the apparatus can be made more compact.

Since the negative pressure inside the inkjet head increases (in other words, the internal pressure of the inkjet head decreases) as the amount of ink inside the inkjet head decreases, then when the internal pressure of the inkjet head has fallen below a prescribed threshold value, the inkjet head is coupled with the ink supply channel, and the internal pressure of the inkjet head is returned to the liquid head pressure differential between the inkjet head and the ink cartridge.

A desirable mode is one in which a plastic film is provided in one or more of the surfaces which constitute the sub tank. Furthermore, the surface where the plastic film is provided may be formed entirely by the plastic film, or it may be formed partially by the plastic film.

Preferably, the inkjet recording apparatus further comprises: a volume determination device which determines a volume change in the sub tank according to an amount of deformation of the elastically deformable member, wherein the internal pressure of the inkjet head is determined through the volume determination device, and the inkjet head and the ink supply channel is coupled and separated in accordance with the determined internal pressure of the inkjet head.

According to this aspect of the present invention, it is possible to determine the pressure inside the inkjet head by means of a simple method.

One mode for determining the volume change in the sub tank is one where the volume change in the sub tank is determined on the basis of the amount of deformation of the elastically deformable member. In other words, there is a mode in which the volume determination device includes an actuator (volume converting device) which moves in accordance with the deformation of the elastically deformable member (for example, the plastic film provided on one wall of the sub tank), and a determination element which determines the amount of movement of this actuator.

Preferably, the negative pressure maintaining unit further includes: a bubble collecting section which is disposed on an upper side of the sub tank, bubbles separated from the ink in the sub tank collecting in the bubble collecting section; and a bubble expulsion port through which the bubbles collected in the bubble collecting section are expelled, and the inkjet recording apparatus further comprises: a bubble expulsion channel which has a second opening and closing member and connects with the bubble expulsion port in the upper part of the negative pressure maintaining unit; and a suctioning device which suctions an interior of the negative pressure maintaining unit from an end of the bubble expulsion channel opposite to an end connecting to with the bubble expulsion port.

According to this aspect of the present invention, a composition is adopted in which bubbles which have entered into the inkjet head can be expelled to the exterior via the sub tank and the bubble collecting section, and therefore it is possible to prevent the occurrence of ejection abnormalities caused by infiltration of bubbles into the head.

The suctioning device may adopt a mode which includes a suctioning element (suctioning member), such as a pump, and a suction control device which controls this suctioning element. The suction control device may be combined with other control systems provided in the inkjet recording apparatus.

A desirable mode of the second opening and closing member (bubble expulsion channel opening and closing member) is one which uses a unidirectional connecting mechanism (for example, a check valve), which allows suctioning only in the direction from the sub tank toward the suctioning device. The second opening and closing member is controlled, for example, in such a manner that a negative pressure is maintained inside the sub tank (inkjet head) (namely, the second opening and closing member is set to a closed state), during printing or standby for printing, whereas the second opening and closing member is set to an open state during bubble expulsion, in such a manner that the bubbles inside the sub tank can be expelled.

Preferably, the suctioning device serves as a suctioning device for suctioning the interior of the inkjet head from an ink ejection face of the inkjet head.

According to this aspect of the present invention, bubbles inside the inkjet head can be expelled without providing a separate suctioning device for expelling bubbles, and therefore the inkjet recording apparatus may be made more compact and the composition thereof can be simplified, thus contributing to reduced costs.

A desirable mode is one in which the end of the bubble expulsion channel connected to the sub tank, which is at the opposite end from the sub tank (bubble collecting section), is disposed in the vicinity of the nozzle forming surface of the inkjet head.

Preferably, the inkjet recording apparatus further comprises a suction switching device which switches the suctioning device between suctioning from the bubble expulsion port of the negative pressure maintaining unit and suctioning from the ink ejection surface of the inkjet head.

According to this aspect of the present invention, by adopting a composition in which it is possible to switch between suctioning from the bubble expulsion port and suctioning from the ink ejection surface, it becomes possible to expel bubbles from the sub tank (the inkjet head) without having to perform a bubble expulsion operation from the ink ejection surface, and therefore it is possible to restrict the amount of ink consumed wastefully by the suctioning operation, in comparison with suctioning in the related art which removes bubbles inside the head via the ink ejection surface.

Preferably, the ink cartridge includes: an ink cartridge container of which interior is connectable to atmosphere; and an ink accommodating member which holds the ink, is accommodated in the interior of the ink cartridge container, has a planar shape of a similar form to the ink cartridge container, and has folds which allow the ink accommodating member to fold in a concertina fashion in the vertical direction as an amount of the ink inside the ink accommodating member decreases.

According to this aspect of the present invention, by determining the thickness of the ink accommodating member (the length of same in the vertical direction), it is possible readily to ascertain the remaining amount of ink held in the ink accommodating member.

According to the present invention, since the recording medium supply device is disposed to the lower side of the inkjet head, in the vertical direction, the ink cartridge which accommodates ink to be supplied to the inkjet head is disposed between the inkjet head and the recording medium supply device in the vertical direction (in other words, in the conveyance space of the recording medium), and a composition is adopted whereby the recording medium supply device and the ink cartridge can be installed in and removed from the inkjet recording apparatus via the front face side of the inkjet recording apparatus, then it is possible to make the inkjet recording apparatus more compact, while also making the upper face of the inkjet recording apparatus a free space and thus allowing other items of equipment to be disposed on the upper face of the inkjet recording apparatus. Particularly beneficial effects are obtained in making the inkjet recording apparatus more compact in the installation direction of the recording medium supply device, namely, the depth direction.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
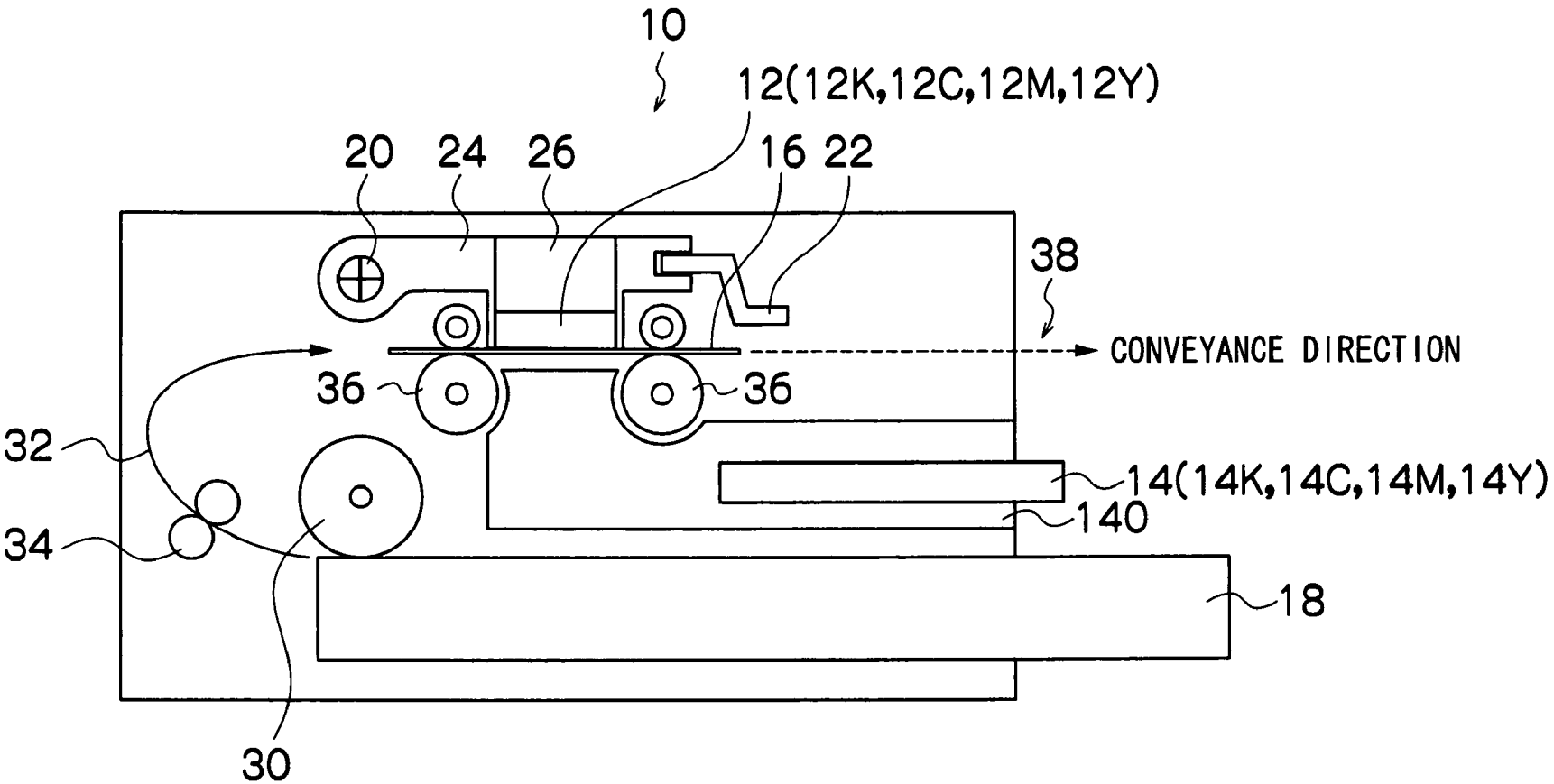
FIG. 1 is a basic schematic drawing of an inkjet recording apparatus according to an embodiment of the present invention.

FIG. 1 is a diagram of the general composition of an inkjet recording apparatus according to an embodiment of the present invention. As shown in FIG. 1, this inkjet recording apparatus 10 includes: a print unit 12 having a plurality of print heads (inkjet heads) 12K, 12C, 12M and 12Y, provided for respective colors (black (K), cyan (C), magenta (M) and yellow (Y)) of ink; ink cartridges 14 (14K, 14C, 14M and 14Y) which store inks to be supplied to the respective print heads 12K, 12C, 12M and 12Y; a paper supply unit 18, which supplies recording paper 16; a carriage 24, which moves the print unit 12 for scanning the recording paper along a guide 22, while being supported by a guide shaft 20, in a main scanning direction which is substantially perpendicular to the conveyance direction of the recording paper; and negative pressure maintaining units 26, provided in equal number to the print heads, which couple respectively with the print heads 12K, 12C, 12M and 12Y of the respective colors in the print unit 12, and generate a negative pressure inside the respective print heads 12K, 12C, 12M and 12Y.

The paper supply unit 18 uses a system based on a paper supply cassette, which is loaded with cut paper that has been cut to a prescribed size. In order to print onto recording papers 16 of a plurality of sizes, the paper supply cassette fitted to the paper supply unit 18 is removed and replaced with a paper supply cassette loaded with recording paper 16 of the desired size. It is also possible to prepare cassettes loaded with recording papers 16 of the same size but different paper types.

In this way, the inkjet recording apparatus 10 is composed in such a manner that it can be used with recording papers of a plurality of types, and by attaching an information recording body, such as a barcode or radio tag, which stores type information relating to the loaded recording paper 16, to the cassette, and reading in the information of this information recording body, by means of a prescribed reading apparatus, the inkjet recording apparatus 10 is able to judge automatically the type of paper being used, and hence the various units inside the inkjet recording apparatus 10 can be controlled in accordance with the type of paper. For example, ink ejection is controlled in such a manner that suitable ink ejection is achieved in accordance with the type of recording paper 16.

The recording paper 16 loaded in the paper supply unit 18 is conveyed to a conveyance path 32 by the rotation of a paper supply roller 30, and is then conveyed in the upward vertical direction by conveyance rollers 34 provided in the conveyance path 32, while at the same time the front/rear surface orientation of the paper is reversed in the conveyance path 32 (the paper is turned once in the conveyance path 32) and the paper is conveyed to a position directly below the print unit 12. The recording paper 16 is then conveyed directly below the print unit 12 in a prescribed conveyance direction within a horizontal plane (the sub scanning direction, indicated by the arrow in FIG. 1), at a uniform conveyance pitch, while being kept to a prescribed flatness by the conveyance rollers 36.

When the recording paper 16 arrives at a print region directly below the print unit 12, then printing in the main scanning direction is carried out by ejecting inks of respective colors from the nozzles provided on the faces of the print heads 12K, 12C, 12M and 12Y which face the recording paper 16, while moving the carriage 24 for scanning the recording paper 16 in the main scanning direction. When one printing action in the main scanning direction has finished, the recording paper 16 is conveyed through a prescribed distance in the sub scanning direction, and printing in the main scanning direction is carried out again while moving the carriage in the main scanning direction. In this way, by repeating a printing action in the main scanning direction while conveying the recording paper 16 successively through a uniform pitch in the sub scanning direction, a desired image is recorded on the whole surface of the recording paper 16. The recording paper 16 on which the desired image has been formed is then conveyed in a prescribed conveyance direction and output to the exterior of the apparatus from the paper output unit 38.

The ink cartridges 14 which store inks to be supplied respectively to the respective print heads 12K, 12C, 12M and 12Y (the K ink cartridge 14K corresponding to the K ink, the C ink cartridge 14C corresponding to the C ink, the M ink cartridge 14M corresponding to the M ink, and the Y ink cartridge 14Y corresponding to the Y ink; referred to jointly as the ink cartridge(s) 14 below), are installed through introduction apertures 142K, 142C, 142M and 142Y (see FIG. 5) provided in a sub cartridge 140 which is separable from the main body of the inkjet recording apparatus 10. When the ink cartridges 14 are installed on the sub cartridge 140, the ink cartridges 14 are coupled to ink supply channels (146 shown schematically in FIG. 5) provided inside the sub cartridge 140.

In the inkjet recording apparatus 10 shown in the present embodiment, the sub cartridge 140 has a structure which allows the ink cartridges 14 to be installed and removed from the front face side of the inkjet recording apparatus 10, and the main body of the inkjet recording apparatus 10 has a structure which allows the sub cartridge 140 fitted with ink cartridges 14 to be installed in and removed from the main body of the inkjet recording apparatus 10, via the front face side of the inkjet recording apparatus 10.

In other words, the sub cartridge introduction aperture for introducing the sub cartridge 140 is provided in the front face of the main body of the inkjet recording apparatus 10, and the ink cartridge introduction apertures (142K, 142C, 142M and 142Y shown in FIG. 5) for introducing the ink cartridges 14 are provided on the front face of the sub cartridge (namely, the face which corresponds to the front face of the inkjet recording apparatus 10 when the sub cartridge 140 is installed in the main body of the inkjet recording apparatus 10).

Structure of Print Heads

Next, the structure of the print head is described. The print heads 12K, 12C, 12M, 12Y corresponding to the inks of the respective colors have the same structure, and therefore, they are collectively denoted with the reference numeral 50 below.

Figure 2:
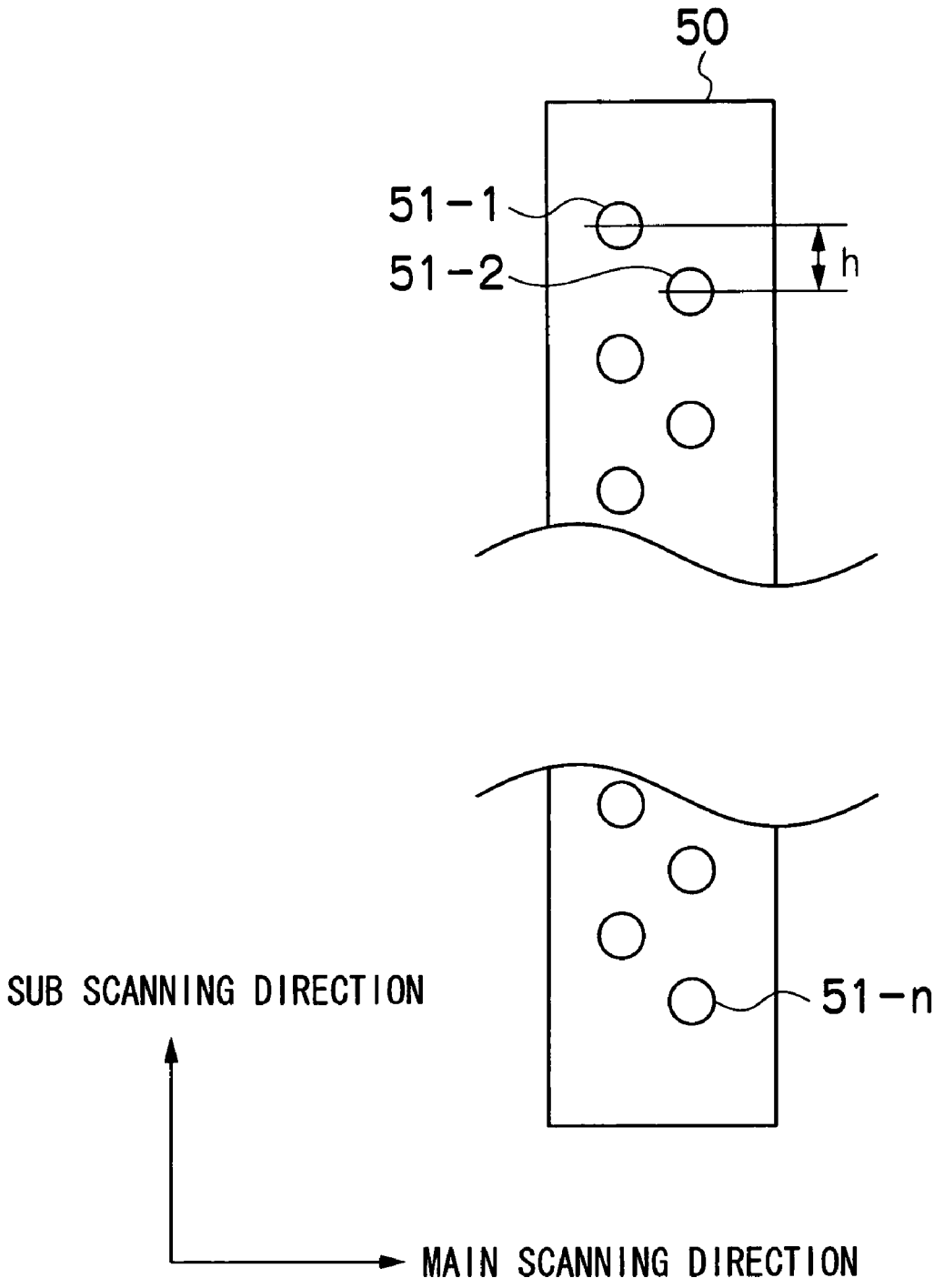
FIG. 2 is a plan diagram showing a nozzle arrangement in the inkjet head shown in FIG. 1.

FIG. 2 shows an embodiment of the arrangement of nozzles 51. The print head 50 has n nozzles 51 (51-1 to **51-*n*) and these n nozzles are arranged in a staggered configuration in two rows. By arranging the nozzles 51 in the staggered configuration in this way, it is possible to reduce the effective nozzle pitch in the sub scanning direction. With the nozzle arrangement shown in FIG. 2, the effective nozzle pitch in the main scanning direction is the distance h in the sub scanning direction between mutually adjacent nozzles (for example, between the nozzle 51-1 and the nozzle 51-2**).

Figure 3:
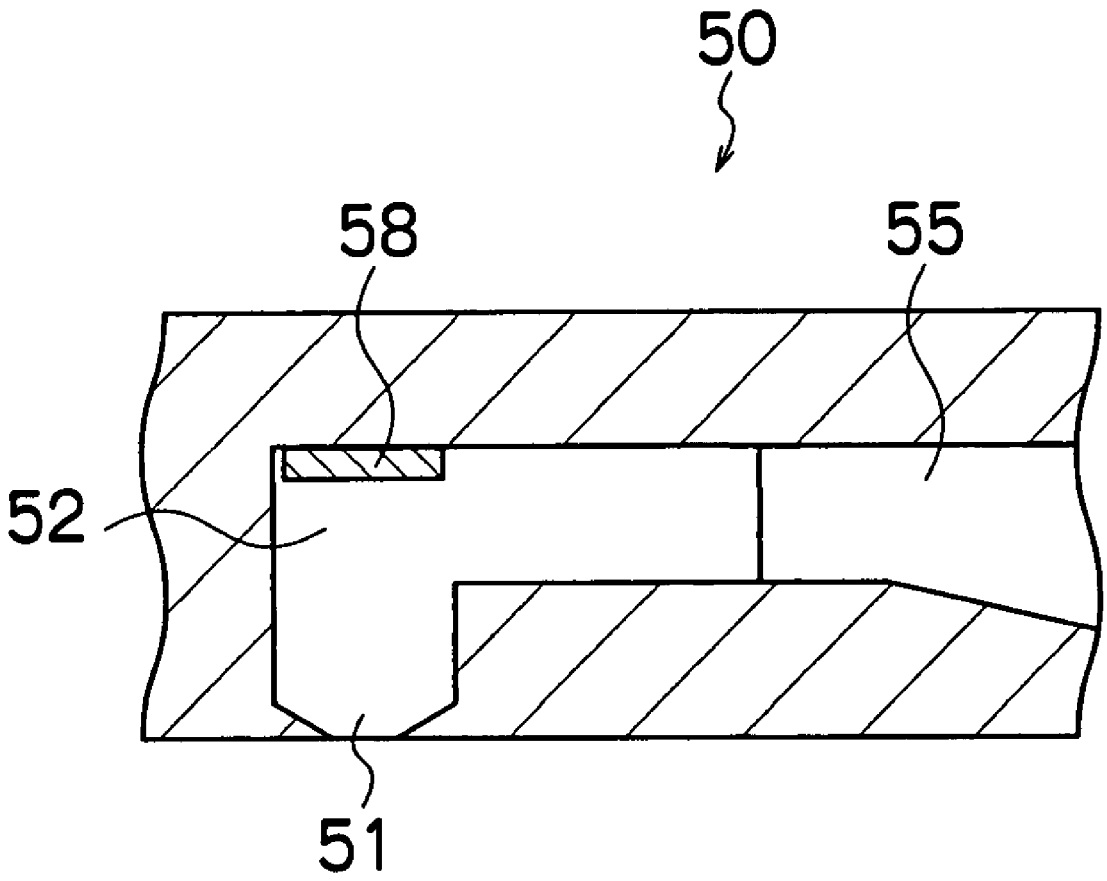
FIG. 3 is a diagram showing the inner structure of the inkjet head shown in FIG. 1.

FIG. 3 is a cross-sectional diagram showing the inner structure of the print head 50. Each nozzle 51 is connected to a pressure liquid chamber 52 which accommodates the ink. The pressure liquid chambers 52 are connected to a common flow channel 55, which supplies the ink to the plurality of pressure liquid chambers 52.

Pressurizing devices (heaters) 58 which apply pressure to the ink inside the pressure liquid chambers 52 are provided inside the pressure liquid chambers 52, and by driving the pressurizing devices 58, bubbles are generated inside the pressure liquid chambers 52 and the ink is ejected from the nozzles 51 due to the pressure of the bubbles. In other words, the print head 50 shown in the present embodiment employs a thermal method which uses the pressure of a bubble generated in the pressure liquid chamber due to the heating energy of a heater, as a force for ejecting ink.

Description of Control System

Figure 4:
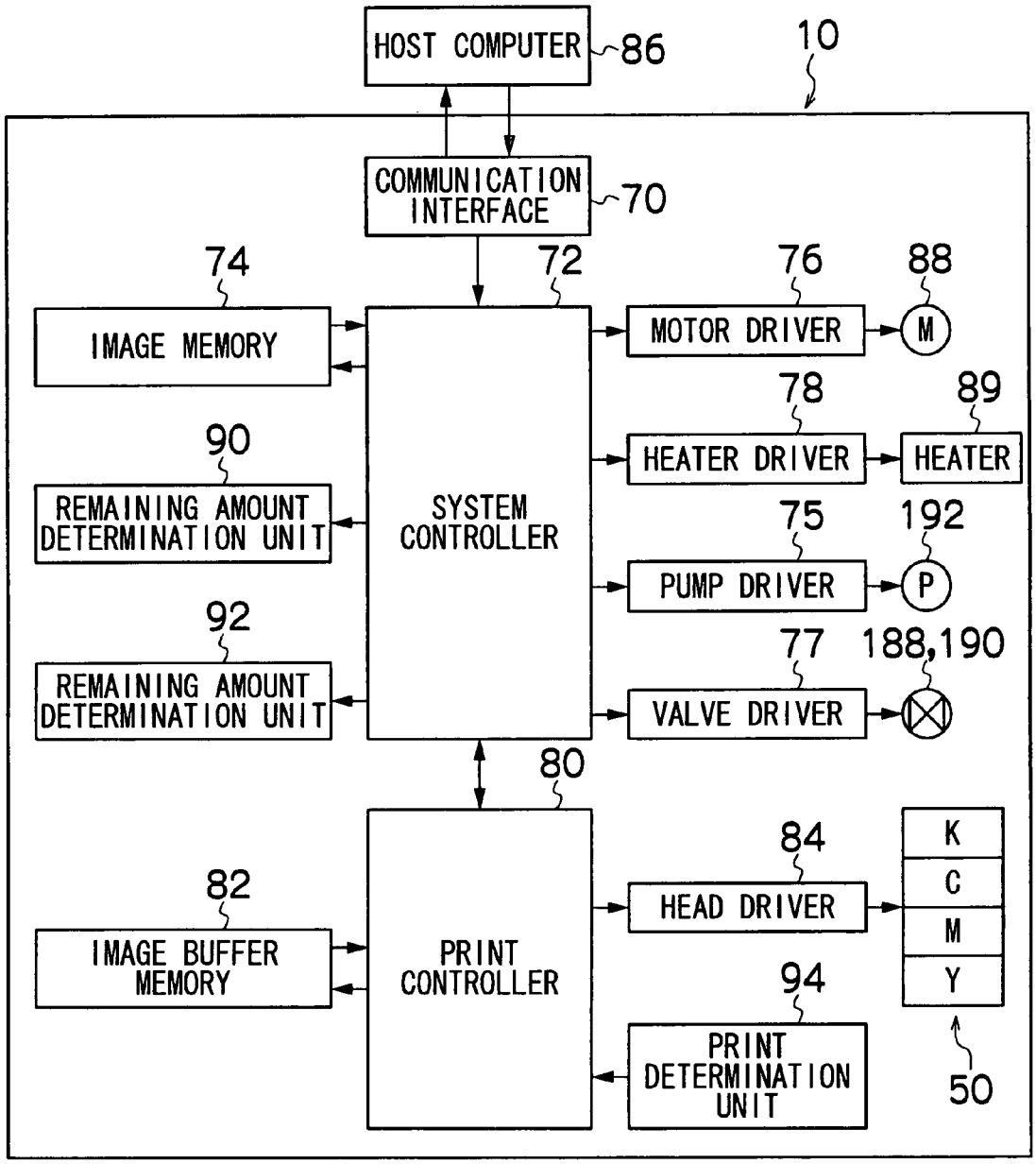
FIG. 4 is a block diagram showing the approximate composition of a control system of the inkjet recording apparatus shown in FIG. 1.

FIG. 4 is a block diagram showing the composition of the control system of the inkjet recording apparatus 10.

The inkjet recording apparatus 10 includes a communication interface 70, a system controller 72, an image memory 74, a pump driver 75, a motor driver 76, a valve driver 77, a heater driver 78, a print controller 80, an image buffer memory 82, a head driver 84, and the like.

The communication interface 70 is an interface unit for receiving image data transmitted by a host computer 86. For the communication interface 70, a serial interface, such as USB (Universal Serial Bus), IEEE 1394, an Ethernet, or a wireless network, or the like, or a parallel interface, such as a Centronics interface, or the like, can be used. It is also possible that the communication interface 70 is provided with a buffer memory (not illustrated) for achieving high-speed communication. Image data sent from the host computer 86 is read into the inkjet recording apparatus 10 through the communication interface 70, and it is stored temporarily in the image memory 74. The image memory 74 is a storage device for temporarily storing the image data input through the communication interface 70, and data is written to and read from the image memory 74 through the system controller 72. The image memory 74 is not limited to a memory composed of a semiconductor element, and a magnetic medium, such as a hard disk, or the like, may also be used.

The system controller 72 is a control unit for controlling the various sections, such as the communication interface 70, the image memory 74, the pump driver 75, the motor driver 76, the valve driver 77, the heater driver 78, and the like. The system controller 72 is constituted by a central processing unit (CPU) and peripheral circuits thereof, and the like, and in addition to controlling communication with the host computer 86 and controlling reading and writing from and to the image memory 74, or the like, it also generates a control signal for controlling a motor 88 of the conveyance system and a heater 89.

The pump driver 75 is a control block which controls the on and off switching, and the drive direction of a pump 292 provided in a restoration processing unit 160 (see FIG. 5) of the print head 50, and the like.

The motor driver 76 is a driver (drive circuit) which drives the motor 88 in accordance with instructions from the system controller 72. FIG. 4 depicts a plurality of motor drivers and a plurality of motors driven by the motor drivers, in the form of the motor driver 76 and the motor 88, but the system controller 72 actually controls a plurality of motor drivers and motors.

To give examples, there is a motor that drives the paper supply drum shown in FIG. 1, a motor that operates the carriage 24, a motor that drives the conveyance rollers 34 and 36 provided in the conveyance path of the recording paper 16, and the like.

The valve driver 77 is a control block which opens and closes valves 288 and 290 (see FIG. 15) provided in the ink supply system, which is described later.

Furthermore, the heater driver 78 is a driver which drives the heater 89 in accordance with instructions from the system controller 72.

In other words, the system controller 72 sends control signals for the respective units, such as the pump driver 75, the motor driver 76, the valve driver 77, the heater driver 78, and the like, and on the basis of these control signals, the pump driver 75 controls the pumps, such as the pump 292, the motor driver 76 controls the motor 88, the valve driver 77 controls the valves 188 and 190, and the motor driver 78 controls the heater 89.

The print controller 80 is a control unit having a signal processing function for performing various treatment processes, corrections, and the like, in accordance with the control implemented by the system controller 72, in order to generate signals for controlling printing from the image data in the image memory 74. The print controller 80 supplies the print control signals (image data) thus generated to the head driver 84. Prescribed signal processing is carried out in the print controller 80, and the ejection amount and the ejection timing of the ink droplets from the print head 50 are controlled through the head driver 84, on the basis of the image data. By this means, prescribed dot sizes and dot positions can be achieved.

An image buffer memory 82 is provided in the print controller 80, and image data, parameters, and other data are temporarily stored in the image buffer memory 82 when image data is processed in the print controller 80. FIG. 4 shows a mode in which the image buffer memory 82 is attached to the print controller 80; however, the image memory 74 may also serve as the image buffer memory 82. Moreover, a mode is also possible in which the print controller 80 and the system controller 72 are integrated and constituted by a single processor.

The head driver 84 drives the pressurizing devices 58 provided in the print heads 50 of the respective colors, on the basis of the print data supplied from the print controller 80. A feedback control system for maintaining constant drive conditions for the heads may be included in the head driver 84.

The print determination unit 94 has an image sensor (an imaging element, such as a CCD) for capturing an image of the print result of the print unit 12, and functions as a device to check for ejection abnormalities such as blockages of the nozzles 51 on the basis of the results read in by the image sensor.

Furthermore, according to requirements, the print controller 80 makes various corrections with respect to the print heads 50 on the basis of information obtained from the print determination unit 94.

The print heads 50 each have remaining amount determination units 90 which determine the remaining amount of ink in the print head 50. During printing, the remaining amount of ink in the print head 50 is determined at periodic intervals, and if the remaining amount is less than a prescribed amount, then the print head 50 is replenished with ink.

Furthermore, the sub cartridge 140 shown in FIG. 1 also has a remaining amount determination unit 92 which determines the remaining amount of ink in the ink cartridges 14. The remaining amount information relating to the ink cartridges 14 obtained by the remaining amount determination unit 92 is displayed by a prescribed display device, and furthermore, if the remaining amount of ink in the ink cartridge 14 has become low, then a notification to this effect is issued by means of a notification device.

Description of Sub Cartridge

Figure 5:
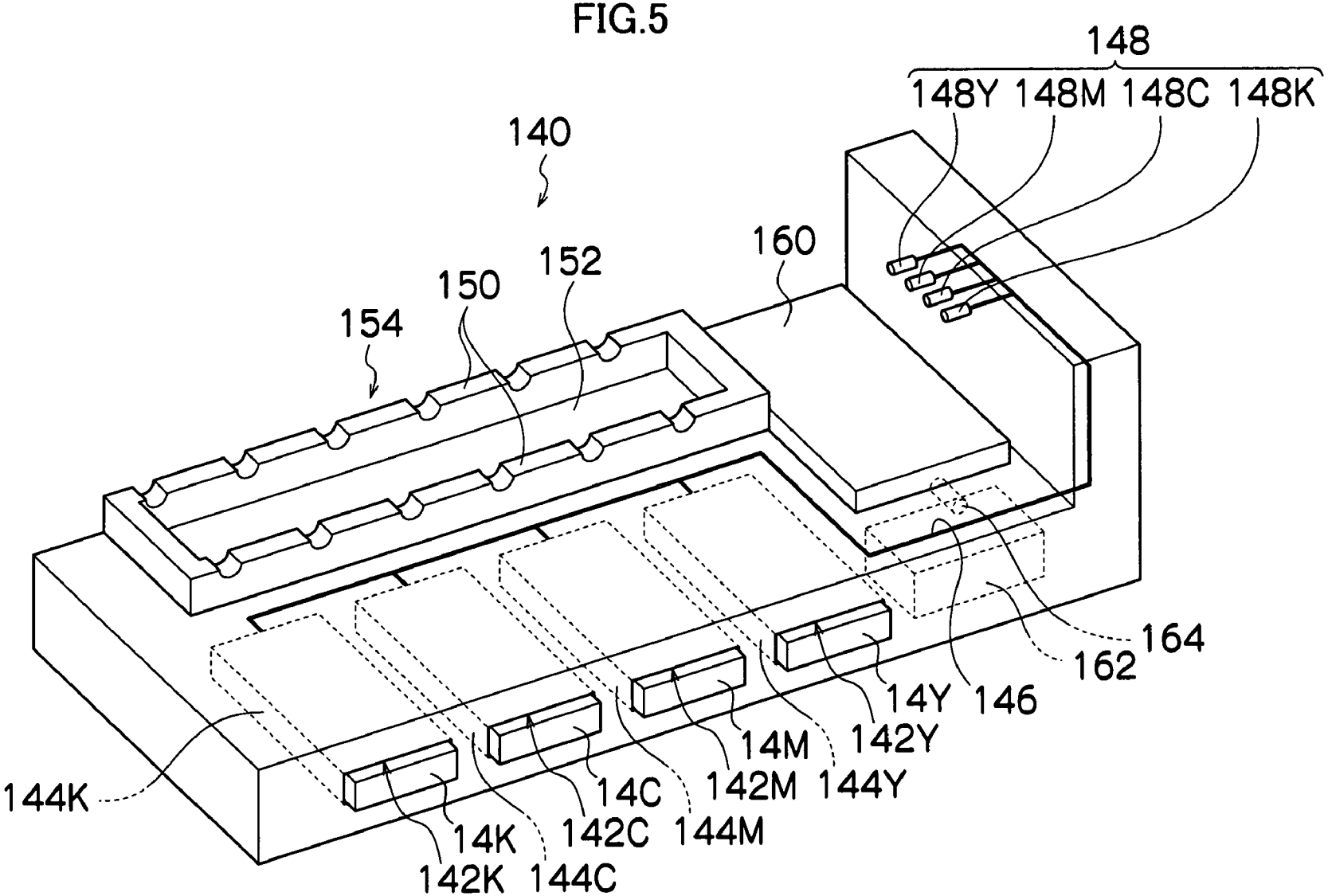
FIG. 5 is an oblique diagram showing the appearance of a sub cartridge installed in the inkjet recording apparatus shown in FIG. 1.
Figure 6:
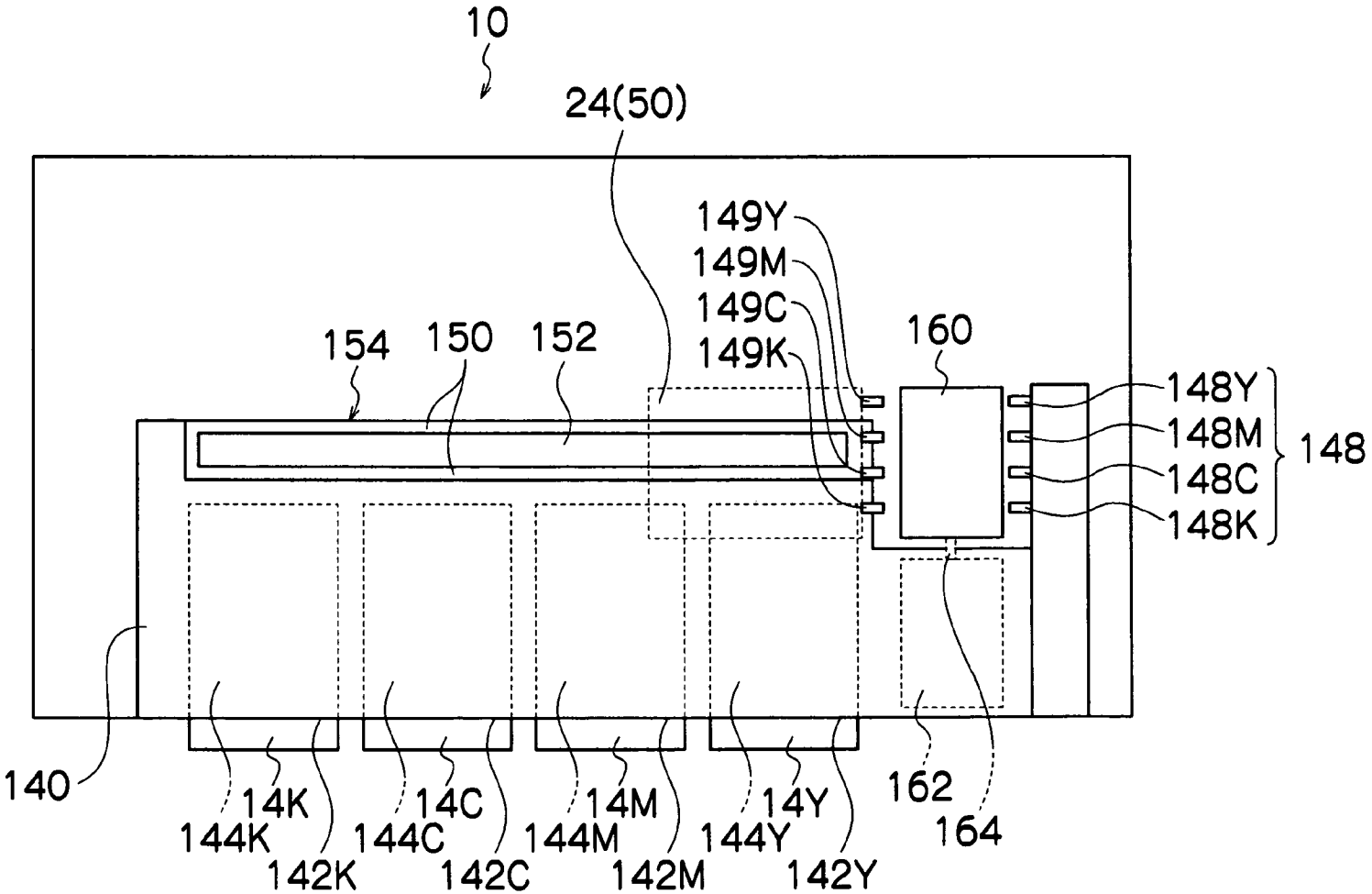
FIG. 6 is an approximate plan diagram of the sub cartridge shown in FIG. 5.

Next, a sub cartridge is described. FIG. 5 shows an oblique diagram of the sub cartridge 140, and FIG. 6 is a plan diagram showing the sub cartridge 140 in an installed state in the main body of the inkjet recording apparatus 10, as viewed from the upper side of the inkjet recording apparatus 10. In FIG. 6, the elements other than the print heads 12K, 12C, 12M, 12Y and the sub cartridge 140 are omitted from the drawing.

As shown in FIG. 5, the sub cartridge 140 has the ink cartridge introduction apertures 142K, 142C, 142M and 142Y, provided on the front face of the sub cartridge 140, through which the ink cartridges 14K, 14C, 14M and 14Y are installed. When the ink cartridges 14K, 14C, 14M and 14Y are installed on the ink cartridge installation units 144K, 144C, 144M and 144Y through the ink cartridge introduction apertures 142K, 142C, 142M and 142Y, then the ink cartridges 14K, 14C, 14M and 14Y connect with ink supply coupling units 148 (148K, 148C, 148M, and 148Y) through ink supply channels 146 provided inside the sub cartridge 140. In FIG. 5, the ink supply channels 146 are depicted schematically by means of a single line, but in fact, the ink flow channels corresponding to the inks of the respective colors are provided independently inside the sub cartridge 140.

The ink supply coupling units 148 form coupling units between the print heads 50 and the sub cartridge 140, and are provided in an end section on one side of the scanning range of the print heads 50 (see FIG. 6) in a state where the sub cartridge 140 is installed in the main body of the inkjet recording apparatus 10.

The inkjet recording apparatus 10 shown in the present embodiment adopts a "pit stop" system by which, when it is necessary to refill ink into the print heads 12K, 12C, 12M and 12Y, then the carriage 24 (see FIG. 6) mounted with the print heads 12K, 12C, 12M and 12Y is moved to the end section on one side of the scanning range, where the ink supply coupling units 148 are provided, and the print heads 12K, 12C, 12M and 12Y couple with the sub cartridge 140 through the negative pressure maintaining units 26.

The ink supply coupling units 148 provided in the sub cartridge 140 each include ink supply pins 204. The ink supply pin 204 has a projecting shape which is designed so as to be able to fit together with the ink supply unit 149 of the negative pressure maintaining unit 26 (shown in FIG. 7). The print heads 50 are coupled with the sub cartridge 140 through the negative pressure maintaining units 26 connected to the print heads 50, but in the present specification, the coupling of the print heads 50 to the sub cartridges 140 through the negative pressure maintaining units 26 is described as "coupling the print heads 50 to the sub cartridge 140".

When the print heads 50 are coupled to the sub cartridge 140, then the print heads 50 (12K, 12C, 12M and 12Y) couple respectively with the ink cartridges 14 (14K, 14C, 14M and 14Y) through the ink supply channels 146, the ink supply coupling units 148, and the negative pressure maintaining units 26 (see FIG. 1). In the inkjet recording apparatus 10 shown in the present embodiment, the ink cartridges 14 are disposed in such a manner that the distance in the vertical direction from the ink cartridges 14 to the positions of the openings of the nozzles 51 in the print head 50 is 10 mm to 50 mm.

In other words, due to the height displacement between the print heads 50 and the ink cartridges 14, a liquid head pressure differential is created between the print heads 50 and the ink cartridges 14, and this liquid head pressure differential creates a negative pressure that is generated inside the print heads 50 when the ink is supplied to the print heads 50.

During printing, the print heads 50 separate from the sub cartridge 140 and the interior of each print head 50 is maintained at a prescribed negative pressure by the function of the respective negative pressure maintaining units 26 (see FIG. 1). The details of the negative pressure maintaining units 26 are described hereinafter.

The position of the print heads 50 where the print heads 50 couple with the sub cartridge 140 is taken as the home position, and during standby for recording, or at the start of a printing process, after the printing process has been completed, or when carrying out maintenance, the carriage 24 is controlled in such a manner that the print heads 50 are moved to the home position.

The sub cartridge 140 has a guide member 154 which combines the functions of a conveyance guide section 150 forming a conveyance guide for the recording paper 16 in the print region, with the functions of an ink receiving section 152 which receives ink that strays outside the width of the recording paper 16 during borderless printing. In this guide member 154, a projecting section formed in the outer edge portion of the guide member 154 acts as the conveyance guide section 150 for the recording paper 16 in the printing region, and the region surrounded by this conveyance guide section (projecting section) 150 forms the ink receiving section 152.

If ink or other dirt becomes attached to this guide member 154, then the user is able to remove the sub cartridge 140 for cleaning or replacement. It is desirable to use a resin material for the guide member 154. The maintenance of the ink receiving section 152 can be carried out more easily by adopting a composition in which an absorbing member which absorbs liquid, such as a porous member or nonwoven cloth, is provided in the ink receiving section 152 in such a manner that the absorbing member can be removed alone from the guide member 154 when the ink receiving section 152 has become full.

A restoration processing unit 160 (not shown in FIG. 5, but shown in FIG. 6) having a cap section (not shown) and an ink suctioning section (not shown) is provided in the sub cartridge 140. When the print heads 50 are in a coupled state (a state where the print heads 50 are in the home position) with the sub cartridge 140, the restoration processing unit 160 is positioned directly below the surfaces in which the nozzles 51 are formed in the print heads 50. The composition of the restoration processing unit 160 includes a cap 282, a valve 288, and a pump 292 (see FIG. 15), as described later.

When not carrying out printing, for instance, before the start of a printing process or during standby for printing, the cap 282 is placed in tight contact the faces of the print heads 50 on which the nozzles 51 are formed, thereby preventing drying of the ink inside the nozzles 51 (inside the print heads 50), and avoiding ejection abnormalities caused by increased viscosity of the ink.

Furthermore, if bubbles have arisen inside the nozzles 51 (inside the print head 50), or if ink of increased viscosity inside the nozzles 51 is to be removed from the nozzles 51, then the cap 282 is placed in tight contact with the faces of the print heads 50 on which the nozzles 51 are formed, and all of the ink in the print heads 50 is suctioned from the nozzles 51 and new ink is supplied from the ink supply unit 149.

The sub cartridge 140 has a waste ink recovery unit (waste ink tank) 162 for recovering waste ink suctioned by the restoration processing unit 160, and a waste ink flow channel 164 which is connected to the restoration processing unit 160 and the waste ink tank 162.

The waste ink tank 162 can be detached from the lower side of the sub cartridge 140 when the sub cartridge 140 has been removed from the main body of the inkjet recording apparatus 10. Consequently, if the waste ink cartridge has become filled with waste ink, then it is possible to remove it from the sub cartridge 140 and replace it with a new waste ink cartridge, and hence only the waste ink tank 162 is discarded. A composition may be adopted in which the ink receiving section 152 and the waste ink tank 162 are coupled through a flow channel member, such as a tube, in such a manner that the ink collected in the ink receiving section 152 is collected into the waste ink tank 162.

By integrating and accommodating the ink supply system that supplies ink to the print heads 12K, 12CM, 12M, 12Y, and the ink recovery system including the ink receiving section 152, the restoration processing unit 160 and the waste ink tank 162, within the sub cartridge 140, as described above, then the user is easily able to carry out maintenance tasks for the ink tubing and the waste ink.

Description of Negative Pressure Maintaining Units

Figure 7:
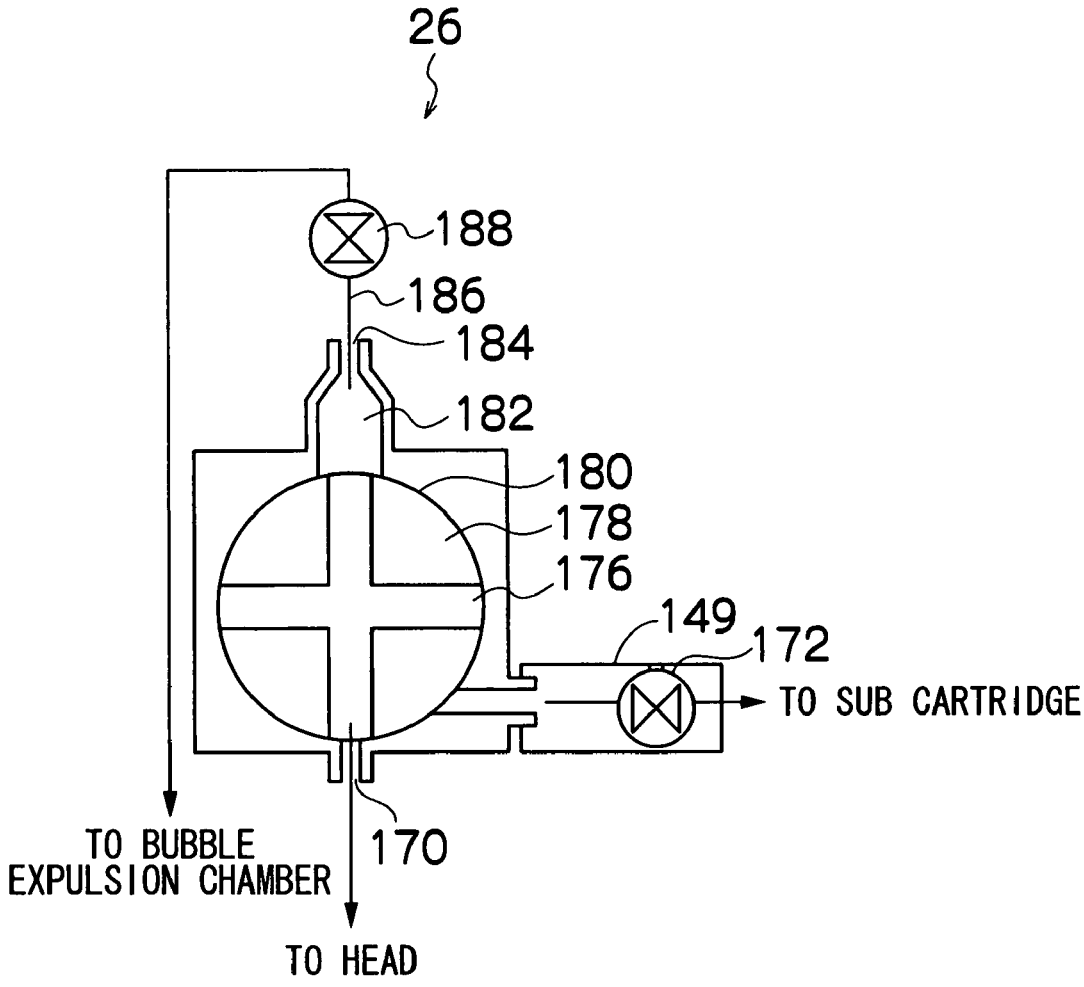
FIG. 7 is a diagram showing the composition of a negative pressure maintaining unit connected to the print head shown in FIG. 1.

Next, the negative pressure maintaining units 26 are described. FIG. 7 is a general compositional diagram showing the structure of the negative pressure maintaining unit 26. The negative pressure maintaining unit 26 shown in FIG. 7 includes: a head coupling aperture 170 that is an aperture for coupling with the print head 50; an ink supply unit 149 that has a valve 172 and couples with the ink supply coupling unit 148 in the sub cartridge 140 (not shown in FIG. 7); a sub tank 180 for temporarily storing ink supplied to the print head 50, which has an elastically deformable member constituted by a leaf spring 176 and a plastic film 178 and is capable of deforming in accordance with change in the internal pressure; and a bubble collecting section 182 where bubbles inside the negative pressure maintaining unit 26 (for example, bubbles which have flown in from the print head 50) are collected.

The sub tank 180 has a structure of which at least a portion deforms elastically when the internal pressure is lower than the atmospheric pressure, and hence a negative pressure is created when the volume of the sub tank 180 is contracted. Furthermore, when the internal pressure of the sub tank 180 has reached atmospheric pressure, then the volume is restored to its original value by the restoring force created by the elastic deformation.

FIG. 7 shows a mode where the leaf spring 176 and the plastic film 178 are provided as the elastically deformable member. In the mode shown in FIG. 7, the elastically deformable member including the leaf spring 176 and the plastic film 178 bonded (welded) together face to face, is provided on at least one of the side faces of the sub tank 180. Besides the composition described above, the elastically deformable member formed by the combination of the leaf spring 176 and the plastic film 178 may also be constituted by welding the leaf springs 176 and the plastic films 178 together in a sandwich fashion. The shape (coefficient of elasticity) of the leaf spring 176 is set appropriately on the basis of the amount of deformation of the elastically deformable member and the force to be generated when it is deformed.

In the case of the sub tank 180 having the composition described above, when the internal pressure of the sub tank 180 is atmospheric pressure, then no deforming force acts on the leaf spring 176, but when ink is suctioned from the print head 50 side (not shown in FIG. 7), thereby creating a negative pressure, the leaf spring 176 deforms in a direction which constricts the volume of the sub tank 180, in such a manner that a negative pressure is created inside the sub tank 180.

The bubble collecting section 182 is connected to a bubble flow channel 186 (bubble expulsion channel) through an expulsion aperture 184, and a valve 188 (second opening and closing member) is provided in the bubble flow channel 186; furthermore, a bubble expulsion chamber 280 (see FIG. 15) is connected to the end of the bubble flow channel 186 on the opposite side from the expulsion aperture 184 (bubble expulsion aperture).

As shown in FIG. 7, the bubbles which have flowed in from the print head 50 collect in the upper part of the sub tank 180, which is formed with a shape (such as a hemispherical shape) in such a manner that the bubbles are guided to the bubble collecting section 182 due to the buoyancy force of the bubbles, rather than becoming trapped.

Figure 8A:
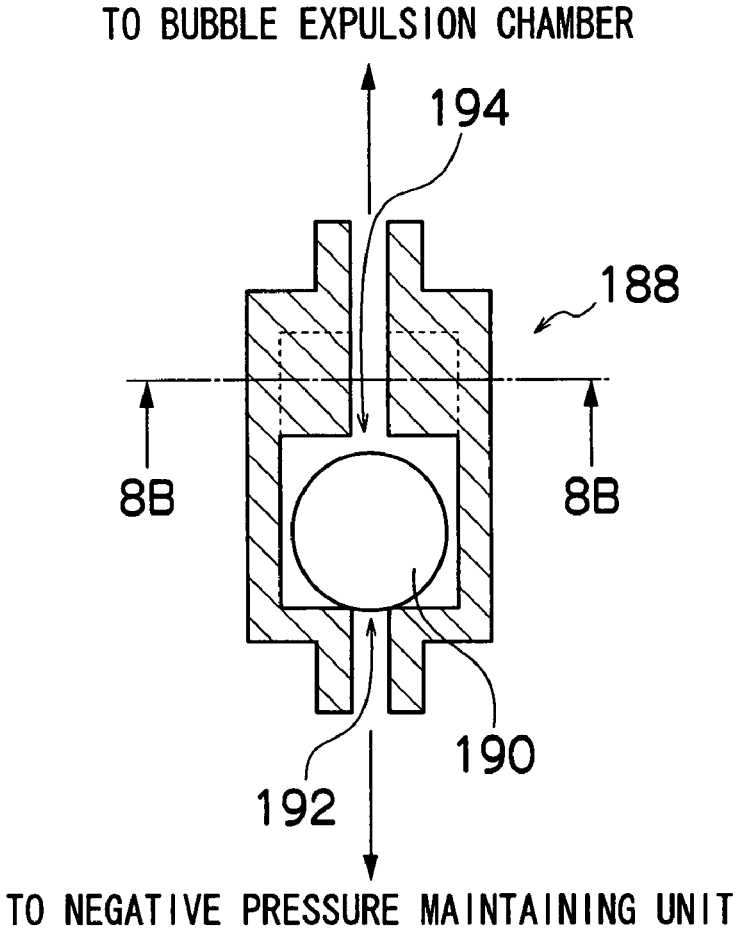
FIGS. 8A and 8B are diagrams for illustrating the structure of a valve connected to the bubble expulsion aperture shown in FIG. 7.
Figure 8B:
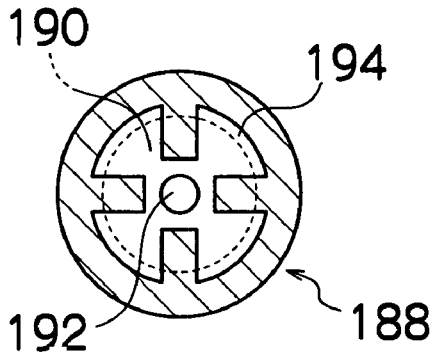

FIGS. 8A and 8B show an embodiment of the structure of the valve 188. As shown in FIG. 8A, the valve 188 has: a substantially spherical check valve 190; an opening 192 having a size which can be sealed by the check valve 190, provided on the side which connects with the negative pressure maintaining unit 26 (the lower side in FIG. 8A); and an opening 194 which is larger than the diameter of the check valve 190 and has projecting shapes on the inner side of a substantially circular shape, provided on the side (the upper side in FIG. 8A) which connects with the bubble expulsion chamber (see FIG. 8B; which is a cross-sectional diagram along line 8B-8B in FIG. 8A).

In a state where it is not suctioned by a pump 292 (see FIG. 15) on the bubble expulsion chamber side, the check valve 190 seals off the opening 192 by making contact with the opening 192, and in a state where it is suctioned by the pump 292 on the bubble expulsion chamber side, the check valve 190 makes contact with the opening 194 and the bubbles are expelled through the gap between the check valve 190 and the opening 194. The structure of the valve 188 shown in FIGS. 8A and 8B is merely one example, and it is also possible to adopt other compositions which have a check valve structure.

Figure 9A:
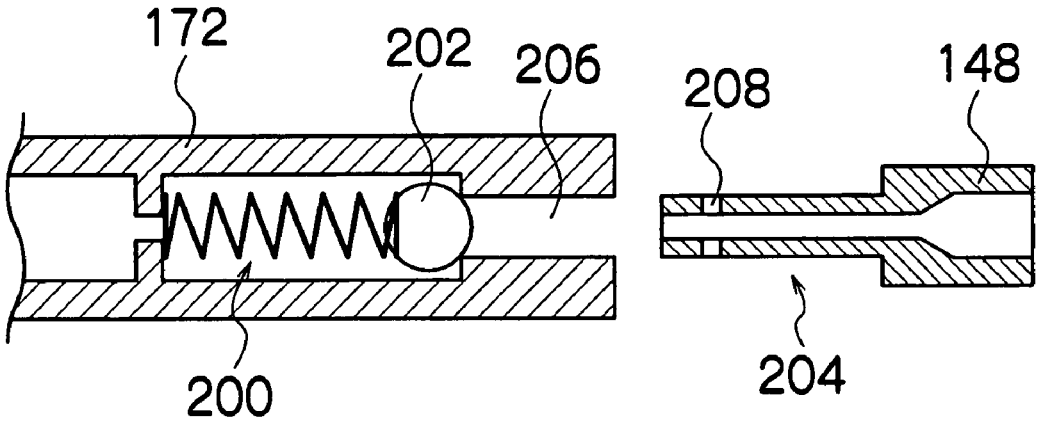
FIGS. 9A and 9B are diagrams for illustrating the structure of a sub cartridge coupling unit and an ink supply coupling unit.
Figure 9B:
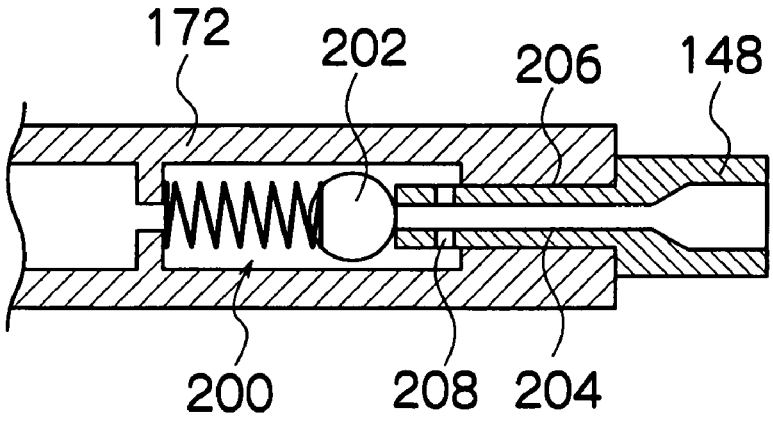

FIGS. 9A and 9B show embodiments of the structure of the valve 172 provided in the ink supply unit 149 of the negative pressure maintaining unit 26 (the first opening and closing member). FIG. 9A shows a state where the negative pressure maintaining unit 26 and the sub cartridge 140 are separated, and FIG. 9B shows a state where the negative pressure maintaining unit 26 and the sub cartridge 140 are coupled together.

In a state where the negative pressure maintaining unit 26 and the sub cartridge 140 are separated, as shown in FIG. 9A, the introduction aperture 206 of the valve 172, into which the ink supply pin 204 of the ink supply coupling unit 148 is introduced, is sealed off by a check valve 202, which is impelled by the force of the elastically deformable member (for example, a spring) 200.

If the ink supply pin 204 is introduced into the introduction aperture 206 in a state where the negative pressure maintaining unit 26 and the sub cartridge 140 shown in FIG. 9B are coupled together, then the check valve 202 is pushed in the opposite direction to the direction of impulsion of the elastically deformable member 200 by means of the ink supply pin 204, and ink flows into the valve 172 from the ink supply coupling section 148 through orifices 208.

By adopting a structure in which the sub cartridge 140 (ink supply system) is coupled with the negative pressure maintaining unit 26 (print head 50) by means of the valve 172 having the check valve structure as shown in FIGS. 9A and 9B, then an appropriate negative pressure is generated inside the print head 50 due to the liquid head pressure differential between the print head 50 and the ink cartridge 14, in the coupled state shown in FIG. 9B, and hence ink can be supplied automatically from the ink supply side to the print head 50. In the separated state shown in FIG. 9A, the negative pressure generated inside the print head 50 is maintained appropriately by the sub tank 180, which is sealed inside the negative pressure maintaining unit 26.

If the print head 50 is separated from the sub cartridge 140 and printing is carried out, thereby consuming the ink inside the print head 50, then the internal pressure (negative pressure) of the negative pressure maintaining unit 26 increases as the ink is consumed. In the inkjet recording apparatus 10 shown in the present embodiment, the internal pressure of the negative pressure maintaining unit 26 is determined and if the internal pressure of the negative pressure maintaining unit 26 exceeds a specific value, then the negative pressure maintaining unit 26 (the print head 50) is coupled with the sub cartridge 140 and ink is supplied to the negative pressure maintaining unit 26.

If the specific value is set to the liquid head pressure differential, then the negative pressure maintaining unit 26 is coupled to the sub cartridge 140 in a state where the internal pressure of the negative pressure maintaining unit 26 has become greater than the liquid head pressure differential, and hence the ink is supplied readily to the negative pressure maintaining unit 26.

Figure 10:
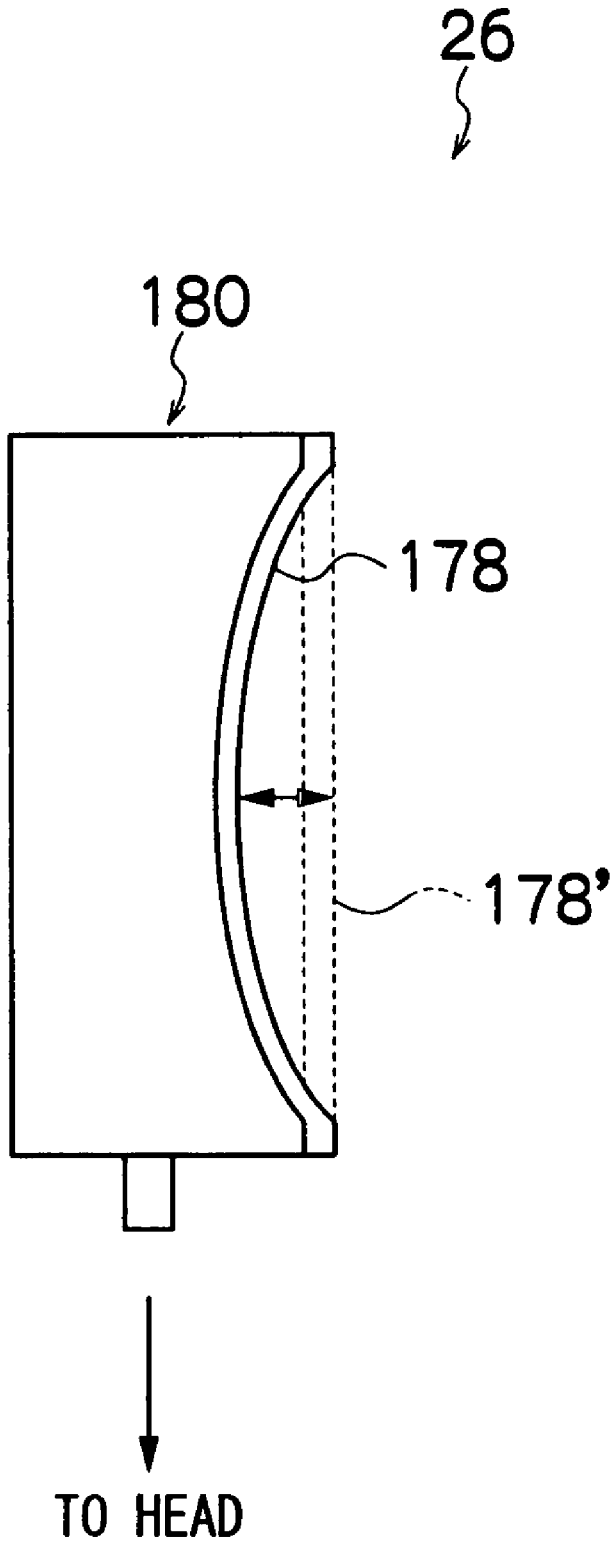
FIG. 10 is a diagram for illustrating the structure of the sub tank shown in FIG. 7.

One embodiment of the internal pressure determination in the negative pressure maintaining unit 26 is described below with reference to FIGS. 10, 11A and 11B. In the internal pressure determination of the negative pressure maintaining unit 26 shown in the present embodiment, the amount of increase in the internal pressure of the negative pressure maintaining unit 26 is determined from the amount of deformation of the plastic film 178. FIG. 10 is the sub tank 180 having the plastic film 178, which is provided inside the negative pressure maintaining unit 26. The broken lines denoted with 178' represent the plastic film 178 in a state where ink has been supplied (an initial state immediately after ink has been supplied), and the plastic film 178 represented with the solid line indicates a state where the internal pressure of the negative pressure maintaining unit 26 has increased due to decrease in the volume of ink inside the print head 50, and ink refilling has become necessary.

As shown in FIG. 10, by constituting a portion of the sub tank 180 which temporarily stores the ink in the negative pressure maintaining unit 26, by means of the plastic film 178, it is possible to substitute the amount of change in the internal pressure of the negative pressure maintaining unit 26 with the amount of deformation of the plastic film 178 (the amount of change in the volume of the negative pressure maintaining unit 26).

Figure 11A:
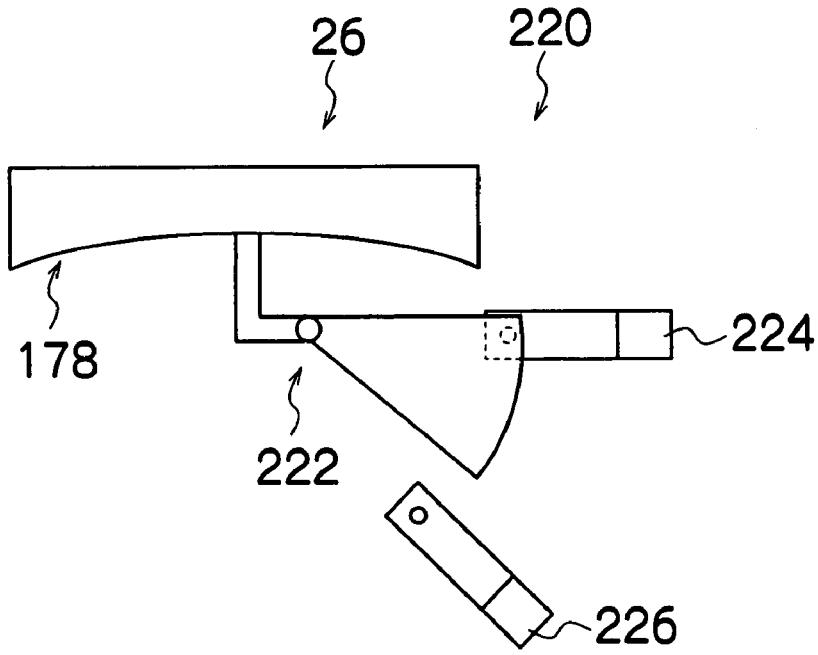
FIGS. 11A and 11B are diagrams illustrating pressure determination in a negative pressure maintaining unit.
Figure 11B:
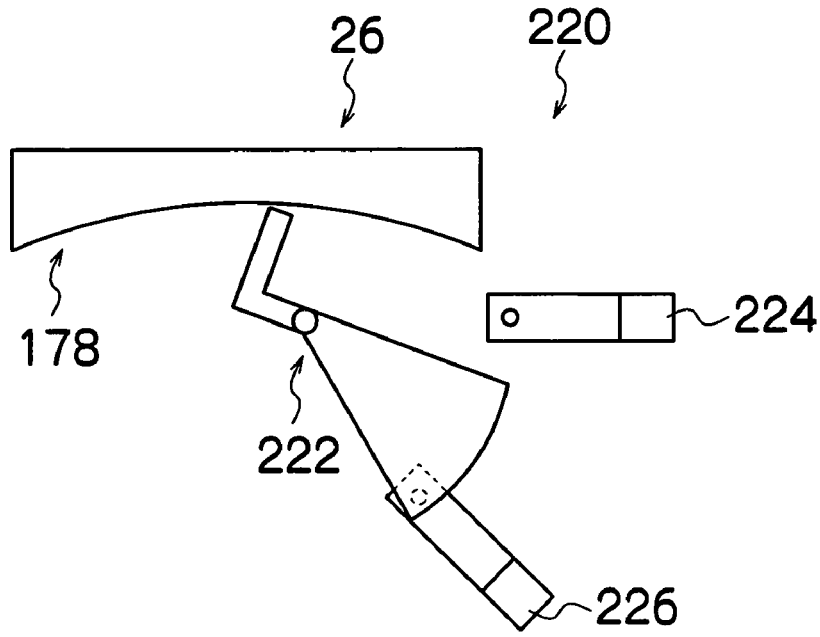

FIGS. 11A and 11B show the composition of a determination unit which determines the amount of deformation of the plastic film 178 (a unit which determines the internal pressure of the negative pressure maintaining unit 26) 220. The amount of deformation determination unit 220 for the plastic film 178 shown in FIGS. 11A and 11B is constituted by an actuator 222 which rotates in accordance with the amount of deformation of the plastic film 178, and two optical sensors 224 and 226.

The first sensor 224 is disposed in a position corresponding to the initial state of the plastic film 178, and it detects the liquid head pressure differential between the print head 50 and the ink cartridge 14 in a state where the negative pressure maintaining unit 26 is coupled to the sub cartridge 140. The second sensor 226 detects the maximum pressure value of the internal pressure of the negative pressure maintaining unit 26 during printing.

FIG. 11A shows a state where the negative pressure maintaining unit 26 and the sub cartridge 140 are coupled together, and the internal pressure of the negative pressure maintaining unit 26 in this state is −10 mm $H_2O$. FIG. 11B shows the upper limit state of the internal pressure in the negative pressure maintaining unit 26 (i.e., when the negative pressure has increased to the upper limit) while carrying out printing (a state where ink replenishment is required), and in this state, the internal pressure of the negative pressure maintaining unit 26 is −70 mm $H_2O$. It is also possible to use a strain gauge (a distortion determination member) instead of the actuator 222 shown in FIGS. 11A and 11B.

FIGS. 11A and 11B show the mode where the two optical sensors are provided, but of these two sensors, it is possible to omit the first sensor 224, provided that there is at least the sensor which can determine whether the amount of deformation of the plastic film 178 (the amount of change in the volume of the sub tank 180) is equal to or greater than a prescribed amount (namely, the second sensor 226 in FIGS. 11A and 11B).

By providing the negative pressure maintaining unit 26 described above, when supplying ink to the print head 50, it is possible to supply ink automatically by means of the liquid head pressure differential between the print head 50 and the ink cartridge 14, without providing a pressure generating device, such as a pump, and during printing, an appropriate negative pressure is generated inside the print head 50, in addition to which it is possible to judge the remaining amount of ink inside the print head 50 on the basis of the change in the internal pressure of the negative pressure maintaining unit 26, and hence ink can be supplied to the print head 50 at a suitable timing.

Description of Ink Cartridges

Next, the ink cartridges 14 are described. The ink cartridges 14 (14K, 14C, 14M and 14Y) corresponding to the respective colors each have the same structure and function.

Figure 12:
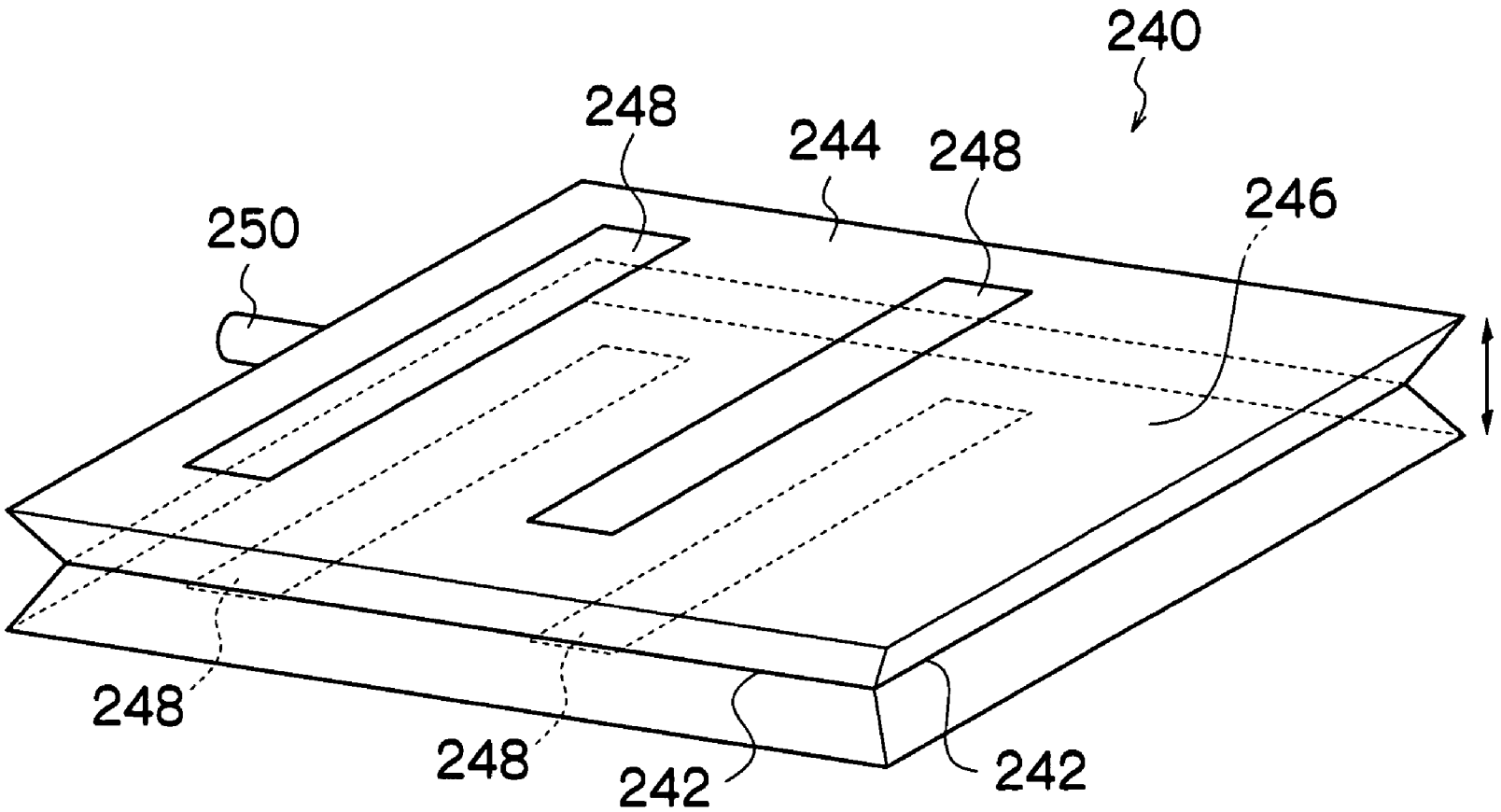
FIG. 12 is an oblique diagram showing the appearance of an ink accommodating bag.

FIG. 12 is an oblique diagram showing the appearance of an ink accommodating bag 240, which is accommodated inside the ink cartridge 14 and which is filled with an ink of one of the respective colors. The ink accommodating bag 240 shown in FIG. 12 has folds 242 in order that it can fold in a concertina fashion when the amount of ink inside the bag reduces, and transparent regions 248 which are at least partially constituted by a transparent material are provided in respective positions corresponding to the surfaces 244 and 246, which are substantially perpendicular to the folding direction (indicated by the arrows in FIG. 12). In the mode shown in FIG. 12, two transparent regions are provided respectively on the surfaces 244 and 246 of the ink cartridge. In FIG. 12, the transparent region of the surface 244 is depicted by solid lines, and the transparent region of the surface 246 is depicted by broken lines.

Of the two transparent regions 248 described above, one is provided in a region which includes substantially the central part of the ink cartridge, and the other is provided in the vicinity of either end section of the ink cartridge in the lengthwise direction of the cartridge (on the side adjacent to a connecting section 250 in FIG. 12).

Furthermore, the ink accommodating bag 240 has the connecting section 250 which connects with the ink supply channel 146 inside the sub cartridge 140, when the ink cartridge 14 is introduced into the ink cartridge installation unit 44 of the sub cartridge 140.

The ink accommodating bag 240 is a flat shape with respect to the folding direction, and it is disposed in such a manner that it extends in a substantially flat plane with respect to direction of gravity. By accommodating the ink accommodating bag 240 inside the ink cartridge 14, improved operability of the ink cartridge 14 during installation and detachment (loading) can be expected, and due to the flat planar shape, the dimension in the height direction of the main body of the inkjet recording apparatus 10 can be reduced.

Figure 13A:
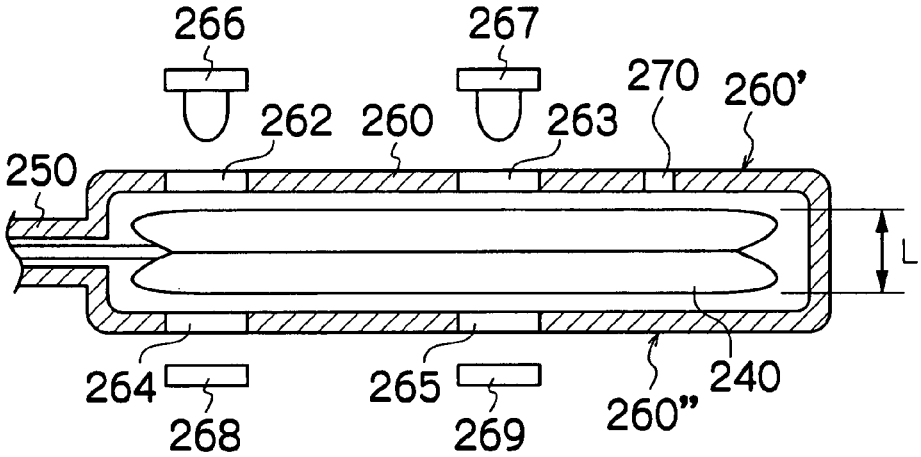
FIGS. 13A, 13B and 13C are diagrams for illustrating the determination of the residual amount in the ink cartridge.
Figure 13B:
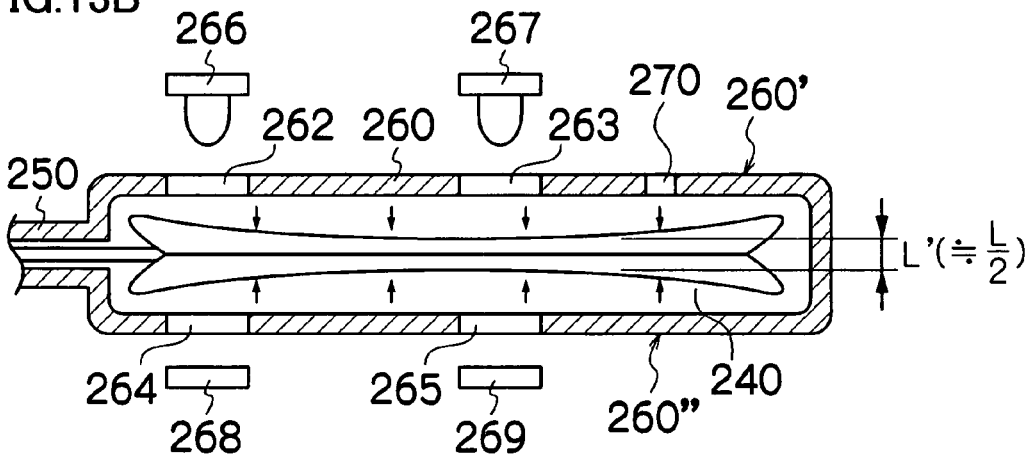
Figure 13C:
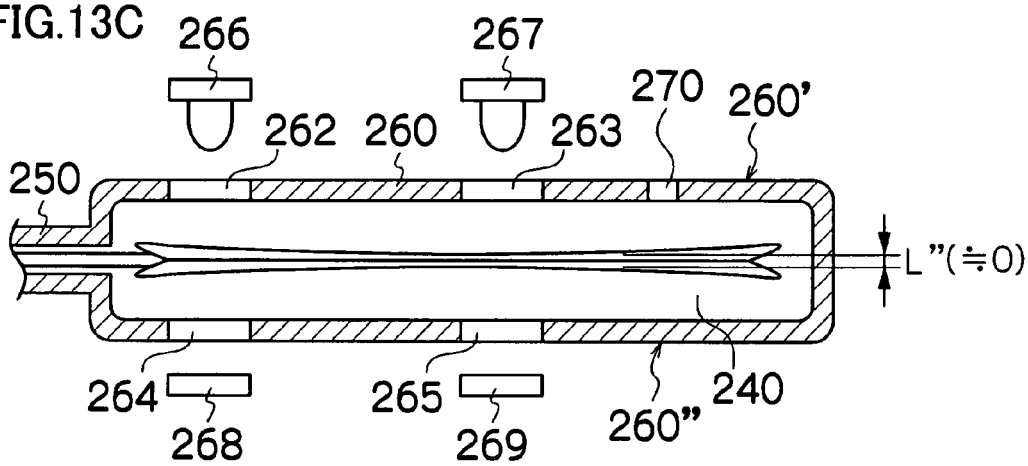
Figure 14:
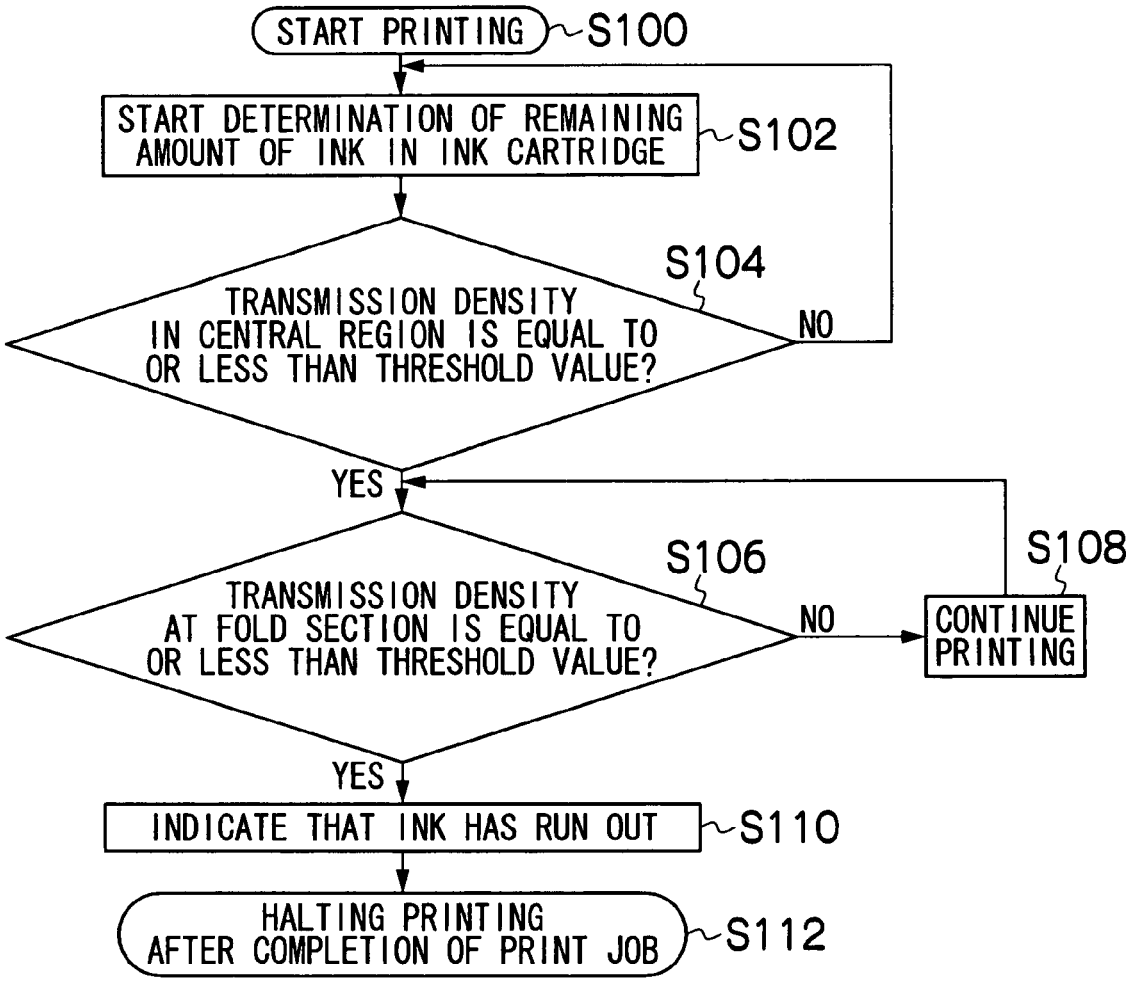
FIG. 14 is a flowchart showing a control sequence of determination of the residual amount in the ink cartridge.

Next, the determination of the remaining amount of ink in the ink cartridges 14 is described with reference to FIGS. 13A to 13C and FIG. 14. FIGS. 13A to 13C are cross-sectional diagrams of the ink cartridge 14, respectively depicting a state where the ink cartridge is filled with ink (initial state), a state where the remaining amount of ink in the ink cartridge is substantially a half, and a state where there is substantially no remaining ink in the ink cartridge (the ink has almost run out). Furthermore, FIG. 14 is a flowchart showing the control sequence of the determination of the remaining amount of ink.

As shown in FIGS. 13A to 13C, in the ink cartridge 14 (the ink cartridge container 260), opening sections 262 to 265 are provided in portions corresponding to the transparent regions 248 (see FIG. 12) of the ink accommodating bag 240 (in the upper surface 260' and the bottom surface 260" of the ink cartridge container 260).

Furthermore, in each of the ink cartridge installation units 144 (144K, 144C, 144M and 144Y) of the sub cartridge 140, a first light-emitting element 266 and a second light-emitting element 267 are provided at positions corresponding to the opening section 262 and the opening section 263 (on the upper side in FIGS. 13A to 13C), and a first light-receiving element 268 and a second light-receiving element 269 are provided at positions corresponding to the opening section 264 and the opening section 265 (on the bottom side in FIGS. 13A to 13C).

As shown in FIGS. 13B and 13C, the thickness of the ink accommodating bag 240 changes from L, to L' (L'<L), to L" (L"<L'), and as the amount of ink inside the ink accommodating bag 240 reduces, so the transmission density reaching the light-receiving element 268 from the light-emitting element 266 becomes lower, and therefore it is possible to determine the remaining amount of ink inside the ink accommodating bag 240 by determining the transmission density received by the light-receiving element 268.

FIG. 13B shows a state where the remaining amount of ink in the ink accommodating bag 240 is approximately ½ (in other words, where L'≈L/2), and FIG. 13C shows a state where the remaining amount of ink in the ink accommodating bag 240 is virtually nil (in other words, L"≈0), and the ink has almost run out.

The remaining amount of ink in the ink accommodating bag 240 is principally determined on the basis of the transmission density of the light-emitting element 267, which is determined by the light-receiving element 269 provided in the central portion. As shown in FIGS. 13A to 13C, the transmission density that is transmitted by the transparent region 248 is directly proportional to the amount of ink inside the ink accommodating bag 240 (namely, the amount of ink determined in a vertical direction when the ink cartridge 14 is installed in the sub cartridge 140).

In other words, if the transmission density has halved, then this means that the amount of ink has also halved, and hence the thickness of the ink accommodating bag 240 has halved; therefore, it is judged that the amount of ink is half the amount of ink in the full state.

Moreover, the light-emitting element 266 and the light-receiving element 268 provided in the vicinity of the folds 242 (in the perimeter section of the ink accommodating bag 240) are used to detect whether the ink has run out. When the remaining amount of ink inside the ink accommodating bag 240 is low, then the ink runs out in the vicinity of the central region of the ink accommodating bag 240 before the region in the vicinity of the fold 242. On the other hand, in the vicinity of the fold 242, ink remains until the very end due to the rigidity of the fold 242.

If the transmission density determined by the light-receiving element 269 provided in the central region becomes equal to or less than a prescribed threshold value, then the transmission density determined by the light-receiving element 268 provided in the vicinity of the fold 242 is monitored, and when the transmission density determined by the light-receiving element 268 becomes equal to or less than a prescribed threshold value, then it is judged that the ink has run out, and a remaining amount of ink notification unit (for example, a display device) issues a notification that the ink has run out.

FIG. 14 shows a flowchart of the control for determining the remaining amount of ink. As shown in FIG. 14, when a print job is started (step S100), a principal remaining amount determination operation is carried out on the basis of the transmission density in substantially the central portion of the ink accommodating bag 240 (step S102), and the procedure then advances to step S104.

At step S104, the transmission density in the approximate central portion of the ink accommodating bag 240 is compared with a prescribed threshold value, and if the transmission density in the approximate central portion of the ink accommodating bag 240 exceeds the prescribed threshold value (NO verdict), then the procedure returns to step S102, and the principal remaining amount determination is continued, whereas if the transmission density in the approximate central portion of the ink accommodating bag 240 is equal to or less than the prescribed threshold value (YES verdict), then the procedure advances to step S106, and the optical density in the vicinity of the fold 242 is determined (step S106).

At step S106, if the transmission density in the vicinity of the fold 242 exceeds the prescribed threshold value (NO verdict), then the print job continues (step S108), and if the transmission density in the vicinity of the fold 242 is equal to or less than a prescribed threshold value (YES verdict), then an "ink out" display (or notification) is issued (step S110), and the print job is terminated (step S112).

Since the thickness of the ink accommodating bag 240 reduces as the amount of ink in the ink accommodating bag 240 becomes lower, then it is also possible to determine the thickness of the ink accommodating bag 250 directly, by means of the opening sections 262 to 265.

An atmosphere connection aperture 270 is provided in the ink cartridge container 260 of the ink cartridge 14, in such a manner that the pressure inside the ink cartridge container 260 in which the ink accommodating bag 240 is accommodated, is kept at atmospheric pressure.

Description of Ink Refilling Control

Figure 15:
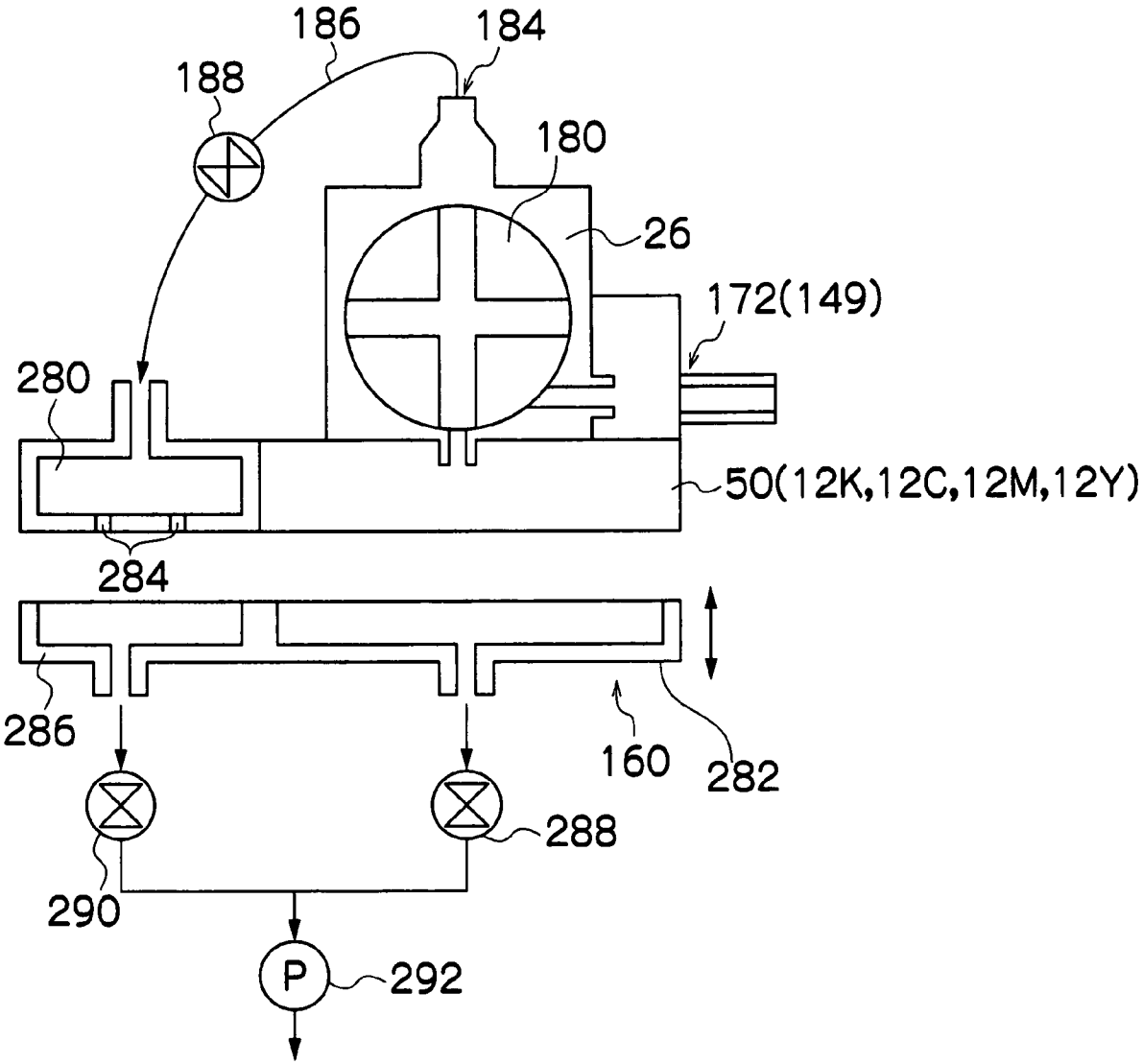
FIG. 15 is a diagram illustrating ink supply in the inkjet recording apparatus shown in FIG. 1.

Next, an ink refilling control procedure for the print head 50 is described. FIG. 15 is a general schematic drawing of the overall composition of the periphery of the print head 50. In FIG. 15, items which are the same as or similar to those described previously are denoted with the same reference numerals and description thereof is omitted here.

As shown in FIG. 15, an expulsion aperture 284 in the negative pressure maintaining unit 26 is connected to a bubble expulsion chamber 280, through the valve 188. The restoration processing unit 160 has the cap 282, which makes tight contact with the nozzles of the print head 50, and a cap 286, which makes tight contact with the expulsion aperture 284 of the bubble expulsion chamber 280.

The cap 282 and the cap 286 are connected respectively to a pump 292 through a valve 288 and a valve 290.

By driving an elevator mechanism (not illustrated), the cap 282 is placed in tight contact with the nozzle forming surface of the print head 50 and the cap 286 is placed in tight contact with the expulsion aperture 284 of the bubble expulsion chamber 280, and by then opening the valve 288 and the valve 290 and operating the pump 292, the ink inside the print head 50 and the negative pressure maintaining unit 26 is suctioned and bubbles inside the print head 50 and the negative pressure maintaining unit 26 are expelled to the exterior. Furthermore, when filling ink into the print head 50, the cap 282 is placed in tight contact with the nozzle forming surface of the print head 50 and the ink is suctioned from the nozzles 51.

The cap 282 and the cap 286 may have respectively separate elevator mechanisms, or the cap 282 and the cap 286 may share the same elevator mechanism, in such a manner that the cap 282 and the cap 286 are raised and lowered together. In the mode shown in FIG. 15, the cap 282 and the cap 286 share a common elevator mechanism.

Next, the control procedure that is implemented when initially filling ink into the print head 50 that has not been filled with ink is described.

Firstly, the ink cartridge 14 is fitted into the main body of the inkjet recording apparatus 10 (the sub cartridge 140), and moving the carriage 24 in such a manner that the print head 50 is moved to the home position, thereby coupling the print head 50 with the sub cartridge 140.

Thereupon, the cap 282 and the cap 286 are raised, and the cap 282 is placed in tight contact with the nozzle forming surface of the print head 50, while the cap 286 is placed in tight contact with the surface where the expulsion aperture 284 of the bubble expulsion chamber 280 is formed.

The valve 288 is closed, the valve 290 is opened, and a negative pressure is applied by the pump 292, whereupon the valve 188 is opened, and ink is filled into the negative pressure maintaining unit 26 (the sub tank 180).

When filling of ink into the negative pressure maintaining unit 26 has finished, the valve 290 is closed, the valve 288 is opened, and a negative pressure is applied by the pump 292, thereby filling ink into the print head 50.

Figure 16:
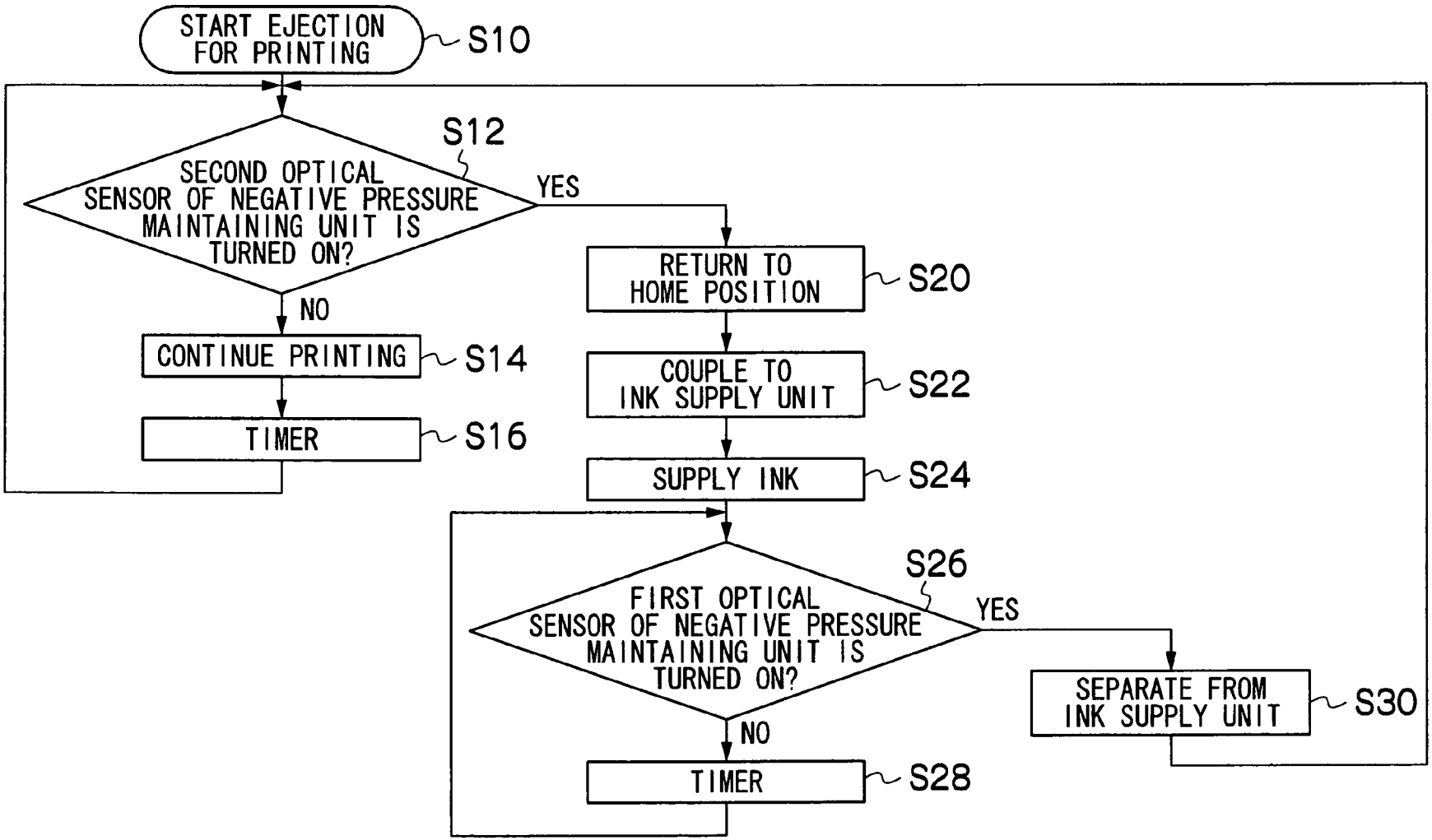
FIG. 16 is a flowchart showing the sequence of ink supply control during printing in the inkjet recording apparatus shown in FIG. 1.

FIG. 16 shows a flowchart of an ink supply control procedure during a printing operation. As shown in FIG. 16, when a printing operation starts (step S10), whether the second sensor 226 in the negative pressure maintaining unit 26 is on (i.e., facing the actuator 222) or not is monitored (step S12). If it is judged that the second sensor 226 is off (NO verdict), then the printing operation continues (step S14), the time period since scanning of the second sensor 226 is measured by using a timer (step S16), and the second sensor 226 is monitored each time that a prescribed time period has elapsed, to check whether it has switched on.

On the other hand, if it is judged at step S12 that the sensor second 226 is turned on (YES verdict), then the print head 50 is moved to the home position (step S20).

When the print head 50 is moved to the home position, the ink supply unit 149 in the negative pressure maintaining unit 26 couples with the ink supply coupling unit 148 in the sub cartridge 140 (step S22), and ink is supplied to the print head 50 (to the sub tank 180 of the negative pressure maintaining unit 26), from the ink cartridge 14 (step S24).

The first sensor 224 is monitored during the supply of ink in step S24 to check whether it has switched on (i.e., it has faced to the actuator 222) (step S26), and if the first sensor 224 is off, then the time period from the previous scan of the first sensor 224 is measured by using a timer (step S28), and each time a prescribed time period has elapsed, the first sensor 224 is monitored to check whether it has switched on.

On the other hand, if it is judged at step S26 that the first sensor 224 is on (YES verdict), then the ink supply unit 149 of the negative pressure maintaining unit 26 is separated from the ink supply coupling unit 148 of the sub cartridge 140 (step S30), and the ink supply control procedure transfers to step S12.

As described above, during initial filling of the ink, the air inside the sub tank 180 is expelled reliably from the bubble flow channel 186 through the expulsion aperture 184 provided on the upper side of the sub tank 180, in a state where the valve 290 is open and the valve 288 is closed, and therefore it is possible to replace the contents of the sub tank 180 with ink.

Furthermore, if bubbles enter in through the ink supply unit 149 when ink supply is repeated during the execution of a print job, then these bubbles collect in the bubble collecting section 182 (see FIG. 7) situated in the top portion of the negative pressure maintaining unit 26 (see FIG. 7). If the bubbles inside the negative pressure maintaining unit 26 increase, then the bubbles inside the sub tank 180 also increase, and consequently, the amount of ink accommodated in the sub tank 180 declines. When the amount of ink inside the sub tank 180 declines in this way, then the number of prints which can be printed after one ink supply action is reduced, and therefore, a desirable control mode is one where the bubbles inside the negative pressure maintaining unit 26 are expelled through the expulsion aperture 184, as appropriate, at the same time as ink supply, in a state where the valve 290 is open and the valve 288 is closed.

In this inkjet recording apparatus 10, if the ink viscosity has increased inside the nozzles 51 (see FIGS. 2 and 3) due to drying of the ink surfaces in the nozzles 51, and if it has therefore become impossible to carry out preliminary ejection, then it is possible to suction the ink of increased viscosity from the nozzles 51 by placing the cap 282 in tight contact with the nozzle forming surface of the print head 50, opening the valve 288 (and closing the valve 290), and operating the pump 292. By suctioning the degraded ink inside the nozzles 51 in this way, the print head 50 can be returned to a state in which it can perform ejection.

Although omitted from the drawings, by dividing the nozzles 51 of the print head 50 into a plurality of blocks and designing the cap 282 with a structure that allows suction to be carried out separately in each individual nozzle block, it is possible to reduce the amount of ink consumed wastefully by the suctioning operation.

As described above, according to a mode in which the device that suctions through the expulsion aperture 184 of the negative pressure maintaining unit 26 also serves as the device that suctions through the cap 282, and a switching device (valve 288 and valve 290) is provided to switch between two types of suction mode (suction route), then by operating and switching the suction mode in a state where the print head 50 and the sub cartridge 140 are coupled together, it is possible to ensure expulsion of bubbles, removal of ink of increased viscosity in the ink surfaces in the nozzles 51, reliable supply of ink into the sub tank 180, and generation and maintenance of negative pressure due to the liquid head pressure differential between the print head 50 and the ink cartridge 14.

Furthermore, since there is a function for removing the bubbles that collect in the upper side of the sub tank 180, based on a gas/liquid separating function inside the sub tank 180, then there is a reduced possibility of ejection abnormalities caused by infiltration of bubbles into the print head 50, and it is possible to expel the bubbles that have been separated from the liquid, alone. Therefore, improved efficiency in the usage of the ink can be expected.

According to the inkjet recording apparatus 10 having the composition described above, the conveyance path along which the recording paper 16 is conveyed from the paper supply unit 18 (paper supply cassette) to the print unit 12 adopts a structure in which the front surface and the rear surface of the recording paper 16 are inverted, and the ink cartridges are provided between the paper supply unit 18 and the print unit 12 that is located above the paper supply unit 18. According to this structure, the operation of installing and removing the paper supply cassette and the ink cartridges 14 is carried out via the front face side of the inkjet recording apparatus 10, and therefore it is possible to reduce the dimensions of the inkjet recording apparatus 10 in the depth direction, as well as ensuring free space on the upper surface of the inkjet recording apparatus 10.

Moreover, by forming the ink cartridges 14 with a flat shape, it is possible to reduce the dimension of the ink cartridges 14 in the height direction, and hence to reduce the overall height of the inkjet recording apparatus 10.

Since the inkjet recording apparatus 10 has the sub cartridge 140 into which the ink cartridges 14 are installed and the ink supply system is accommodated inside the sub cartridge 140, and furthermore, since the sub cartridge 140 is composed in such a manner that it can be installed in and removed from the main body of the inkjet recording apparatus 10 via the front face side of the main body of the inkjet recording apparatus 10, then it is possible to arrange the ink supply system in a compact fashion, and the structure inside the inkjet recording apparatus 10 is simplified. Since the waste ink tank 162 which collects waste ink produced during borderless printing or restoration processing is provided inside the sub cartridge 140, and since this waste ink tank 162 can be installed in and removed from the sub cartridge 140, then improved maintenance characteristics can be expected.

Moreover, since the sub cartridge 140 is provided with the guide member 154 which functions as the conveyance guide section 150 forming the guide for the recording paper 16 in the print region directly below the print unit 12, as well as functioning as the ink receiving section 152 which receives ink that has strayed beyond the width of the recording paper 16 during borderless printing, and since the guide member 154 is composed in such a manner that it can be attached to and detached from the sub cartridge 140, then problems in conveyance of the recording paper 16 in the print region are prevented and maintenance can be carried out readily in respect of soiling of the conveyance guide section 150 occurring during borderless printing.

During the supply of ink, the print heads 50 (12K, 12C, 12M, 12Y) are connected to the ink supply system provided inside the sub cartridge 140 and ink is supplied to the print heads 50 from the ink supply system due to the liquid head pressure differential between the nozzle forming surfaces of the print heads 50 and the ink cartridges. Furthermore, since the negative pressure maintaining units 26 are connected to the print heads 50 in order to control the negative pressure inside the print heads 50 during printing, and since the internal pressure (negative pressure) of the print heads 50 is controlled with reference to the liquid head pressure differential between the nozzle forming surfaces of the print heads 50 and the ink cartridges, then there is no need to provide a pressure generating device, such as a pump, in order to create and maintain a negative pressure inside the print heads 50.

The ink supply system in the inkjet recording apparatus 10 described above is one where the negative pressure maintaining unit 26 is provided in the upper portion of each print head 50, and this negative pressure maintaining unit 26 creates and maintains a negative pressure inside the print head 50 by means of the elastically deformable member (the leaf spring 176 and the plastic film 178; see FIG. 7); and compared to a system in the related art based on a suction member which creates and maintains a negative pressure inside the head by means of capillary action, the amount of ink left inside the ink cartridges 14 is smaller, and hence more efficient use of the ink can be expected.

Moreover, the inkjet recording apparatus 10 adopts a composition which has the gas/liquid separating function inside the sub tank 180 in the print head 50 (see FIG. 7), and therefore, unlike a composition in the related art in which an ink absorbing member having a gas/liquid separating function is provided on the side that separates from the head, there is no occurrence of residual ink left in the ink absorbing member, and no ink wastage arises.

As described above, in a system in the related art in which an ink absorbing member that uses capillary action is interposed in the ink supply unit, a problem arises in that as the viscosity of the ink rises, the pressure loss increases and the responsiveness of the ink supply deteriorates. In particular, in low temperature conditions, the ink viscosity increases, and furthermore, if the print duty is even greater, then problems relating to the response of ink supply arise.

Since the inkjet recording apparatus 10 according to the present embodiment has no ink supply member based on capillary action in the ink supply unit, then the responsiveness of the ink supply is increased and the ink supply time is shortened in comparison with the method in the related art described above. Furthermore, due to the good responsiveness of the ink supply, a uniform negative pressure can be maintained readily inside the print head 50, and therefore, beneficial effects are obtained in preventing variations in the density of the printed matter, and the like.

The embodiments of the present invention described above relate to the inkjet recording apparatus 10 that forms color images on the recording paper 16 by ejecting the ink droplets onto the recording paper 16, but the scope of application of the present invention is not limited to the inkjet recording apparatus, and it may also be applied to a liquid ejection apparatus which ejects other types of liquid, such as water, liquid chemicals, treatment liquid, and the like, from ejection holes (nozzles) provided in a head.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus, comprising:

a casing;

an inkjet head which is arranged in the casing and ejects ink from nozzles toward a recording medium;

a scanning device which is arranged in the casing and moves the inkjet head to scan the recording medium in a scanning direction parallel with a breadthways direction of the recording medium;

a recording medium supply device which accommodates the recording medium and is removably installed into the casing via a front face side of the casing and disposed on a lower side of the inkjet head in a vertical direction of the casing;

a conveyance device which conveys the recording medium from the recording medium supply device to a recording region where the recording medium receives deposition of the ink ejected from the inkjet head, and conveys the recording medium within the recording region in a direction substantially perpendicular to the scanning direction;

an ink cartridge which accommodates the ink to be supplied to the inkjet head and is removably installed into the casing via the front face side of the casing and disposed between the inkjet head and the recording medium supply device in the vertical direction of the casing;

an ink supply channel which is provided between the ink cartridge and the inkjet head;

a coupling unit which is provided in at least one end portion of a scanning region of the inkjet head, and couples and separates the inkjet head with and from the ink supply channel, and wherein the inkjet head and the ink supply channel are coupled together through the coupling unit when the ink is supplied to the inkjet head, and the inkjet head and the ink supply channel are separated from each other when the inkjet head is carrying out printing.

2. The inkjet recording apparatus as defined in claim 1, further comprising:

a sub cartridge which includes the coupling unit, the ink supply channel, and an ink cartridge accommodating section which accommodates the ink cartridge, wherein:

the sub cartridge is removably installed into the casing via the front face side of the casing and disposed to a lower side of the scanning region of the inkjet head in the vertical direction of the casing; and the ink cartridge accommodating section has an introduction aperture for introducing the ink cartridge in a face of the sub cartridge which faces the front face of the casing when the sub cartridge is installed in the casing.

3. The inkjet recording apparatus as defined in claim 2, further comprising:

a restoration processing device which carries out restoration process of the inkjet head, wherein the sub cartridge includes a waste ink accommodating section which accommodates waste ink generated during the restoration process of the inkjet head performed by the restoration processing device and is removably installed into the sub cartridge.

4. The inkjet recording apparatus as defined in claim 2, wherein the sub cartridge includes an ink receiving section which receives the ink ejected beyond edges of the recording medium during full-surface printing for a region corresponding to the scanning region of the inkjet head and is removably installed into the sub cartridge.

5. The inkjet recording apparatus as defined in claim 4, wherein the ink receiving section serves as a conveyance guide for the recording paper in the print region.

6. The inkjet recording apparatus as defined in claim 1, further comprising a negative pressure maintaining unit which includes:

an ink supply port which has a first opening and closing member, couples with the coupling unit, and is connected to an ink flow channel inside the inkjet head; and a sub tank of which portion of wall has an elastically deformable member, and is provided between the inkjet head and the ink supply port, wherein the negative pressure maintaining unit couples with the ink supply channel and maintains an internal pressure of the inkjet head at a liquid head pressure differential between the inkjet head and the ink cartridge during supply of the ink to the inkjet head, and seals an interior of the inkjet head by closing the first opening and closing member when the inkjet head is carrying out printing.

7. The inkjet recording apparatus as defined in claim 6, further comprising:

a volume determination device which determines a volume change in the sub tank according to an amount of deformation of the elastically deformable member, wherein the internal pressure of the inkjet head is determined through the volume determination device, and the inkjet head and the ink supply channel is coupled and separated in accordance with the determined internal pressure of the inkjet head.

8. The inkjet recording apparatus as defined in claim 6, wherein:

the negative pressure maintaining unit further includes:

a bubble collecting section which is disposed on an upper side of the sub tank, bubbles separated from the ink in the sub tank collecting in the bubble collecting section; and a bubble expulsion port through which the bubbles collected in the bubble collecting section are expelled, and the inkjet recording apparatus further comprises:

a bubble expulsion channel which has a second opening and closing member and connects with the bubble expulsion port in the upper part of the negative pressure maintaining unit; and a suctioning device which suctions an interior of the negative pressure maintaining unit from an end of the bubble expulsion channel opposite to an end connecting to with the bubble expulsion port.

9. The inkjet recording apparatus as defined in claim 8, wherein the suctioning device serves as a suctioning device for suctioning the interior of the inkjet head from an ink ejection face of the inkjet head.

10. The inkjet recording apparatus as defined in claim 9, further comprising a suction switching device which switches the suctioning device between suctioning from the bubble expulsion port of the negative pressure maintaining unit and suctioning from the ink ejection surface of the inkjet head.

11. The inkjet recording apparatus as defined in claim 1, wherein the ink cartridge includes:

an ink cartridge container of which interior is connectable to atmosphere; and an ink accommodating member which holds the ink, is accommodated in the interior of the ink cartridge container, has a planar shape of a similar form to the ink cartridge container, and has folds which allow the ink accommodating member to fold in a concertina fashion in the vertical direction as an amount of the ink inside the ink accommodating member decreases.

* * * * *